US009404353B2

(12) United States Patent
Gay et al.

(10) Patent No.: US 9,404,353 B2
(45) Date of Patent: Aug. 2, 2016

(54) WELL TREATMENT DEVICE, METHOD, AND SYSTEM

(71) Applicant: Pioneer Natural Resources USA, Inc., Irving, TX (US)

(72) Inventors: Michael Gay, Norman, OK (US); Charles Espinoza, Alvord, TX (US); Kyle Zemlak, Frisco, TX (US)

(73) Assignee: Pioneer Natural Resources USA, Inc., Irving, TX (US)

( * ) Notice: Subject to any disclaimer, the term of this patent is extended or adjusted under 35 U.S.C. 154(b) by 466 days.

(21) Appl. No.: 13/836,068

(22) Filed: Mar. 15, 2013

(65) Prior Publication Data

US 2014/0069652 A1 Mar. 13, 2014

Related U.S. Application Data

(60) Provisional application No. 61/699,731, filed on Sep. 11, 2012.

(51) Int. Cl.

| | |
|---|---|
| ***E21B 43/26*** | (2006.01) |
| ***E21B 41/00*** | (2006.01) |
| *E21B 34/00* | (2006.01) |

(52) U.S. Cl.

CPC ..... *E21B 43/26* (2013.01); *E21B 41/0057* (2013.01); *E21B 2034/007* (2013.01)

(58) Field of Classification Search

CPC ..... E21B 43/25; E21B 43/26; E21B 41/0057; E21B 2034/007; E21B 43/36; E21B 34/00; E21B 34/06; E21B 34/14

See application file for complete search history.

(56) References Cited

U.S. PATENT DOCUMENTS

| | | | |
|---|---|---|---|
| 5,316,082 | A | 5/1994 | Jennings, Jr. |
| 5,443,124 | A | 8/1995 | Wood et al. |
| 5,538,080 | A | 7/1996 | Bassinger |
| 5,697,441 | A | 12/1997 | Vercaemer et al. |
| 6,098,020 | A | 8/2000 | den Boer |
| 6,131,663 | A | 10/2000 | Henley et al. |
| 6,167,970 | B1 | 1/2001 | Stout et al. |

(Continued)

FOREIGN PATENT DOCUMENTS

| | | | |
|---|---|---|---|
| CN | 1869497 | A | 11/2006 |
| EP | 1041241 | A2 | 10/2000 |

(Continued)

OTHER PUBLICATIONS

International Serach Report based on International Application No. PCT/US2013/059137, form PCT/ISA/210, Apr. 29, 2014, 4 pages.

(Continued)

*Primary Examiner* — Yong-Suk (Philip) Ro

(74) *Attorney, Agent, or Firm* — Charles Knobloch; Arnold, Knobloch & Saunders, L.L.P.

(57) ABSTRACT

A down-hole treatment tool including a tool body having a bore therethrough, a treatment port orifice disposed on the body, a sliding sleeve within the bore of the body. A constant-volume annular chamber, in isolation from the inner bore and the environment outside the body, provides a debris-free environment for locking the sleeve. A dissolvable treatment port cover provides protection of the treatment port until operation of the treatment port is needed. The treatment port cover and lubrication ports enable lubrication of the sleeve and inner bore of the body without risk of contamination by debris.

120 Claims, 19 Drawing Sheets

(56) References Cited

U.S. PATENT DOCUMENTS

| | | | |
|---|---|---|---|
| 8,291,975 | B2 | 10/2012 | Roddy et al. |
| 2001/0018977 | A1 | 9/2001 | Kilgore |
| 2004/0014606 | A1 | 1/2004 | Parlar et al. |
| 2008/0110642 | A1 | 5/2008 | Slack |
| 2008/0236819 | A1 | 10/2008 | Foster et al. |
| 2009/0084553 | A1 | 4/2009 | Rytlewski et al. |
| 2011/0127047 | A1 | 6/2011 | Themig et al. |
| 2011/0204273 | A1 | 8/2011 | Braekke |
| 2011/0308817 | A1 | 12/2011 | Ravensbergen |
| 2012/0055681 | A1 | 3/2012 | Telfer |
| 2012/0181049 | A1 | 7/2012 | Tingler et al. |
| 2012/0247767 | A1 | 10/2012 | Themig et al. |
| 2012/0285687 | A1 | 11/2012 | Turner et al. |
| 2012/0325479 | A1 | 12/2012 | Ravensbergen |
| 2013/0014951 | A1 | 1/2013 | Fitzpatrick |
| 2013/0032349 | A1 | 2/2013 | Alekseenko et al. |

FOREIGN PATENT DOCUMENTS

| | | | |
|---|---|---|---|
| EP | 1496194 | A2 | 1/2005 |
| EP | 1857633 | A2 | 11/2007 |
| EP | 1653043 | B1 | 3/2008 |
| EP | 2027360 | B1 | 5/2010 |
| FR | 2563583 | A1 | 10/1985 |
| GB | 2240798 | A | 8/1991 |
| GB | 2345505 | A | 7/2000 |
| GB | 2373798 | A | 10/2002 |
| WO | 9604349 | A1 | 2/1996 |
| WO | 2004063527 | A1 | 7/2004 |
| WO | 2004067904 | A1 | 8/2004 |
| WO | 2012027831 | A1 | 3/2012 |
| WO | 2012045156 | A1 | 4/2012 |
| WO | 2012088586 | A1 | 5/2012 |
| WO | 2012092657 | A1 | 7/2012 |
| WO | 2012149638 | A1 | 11/2012 |
| WO | 2012174663 | A1 | 12/2012 |
| WO | 2013022627 | A2 | 2/2013 |

OTHER PUBLICATIONS

Written Opinion of the International Searching Authority based on International Application No. PCT/US2013/059137, form PCT/ISA/237, Apr. 29, 2014, 7 pages.

Notification of transmittal of international preliminary report on paentabilty based on International Application No. PCT/US2013/059137, form PCT/IPEA/416, Jan. 21, 2015, 51 pages.

Chapter II Demand and Article 19 Amendments, filed Jul. 28, 2014, 51 pages.

Supplementary partial European search report based on European Application No. 13837480.6, Apr. 22, 2016, 4 pages.

Communication pursuant to Rule 164(1) EPC based on European Application No. 13837480,6, May 10, 2016, 2 pages.

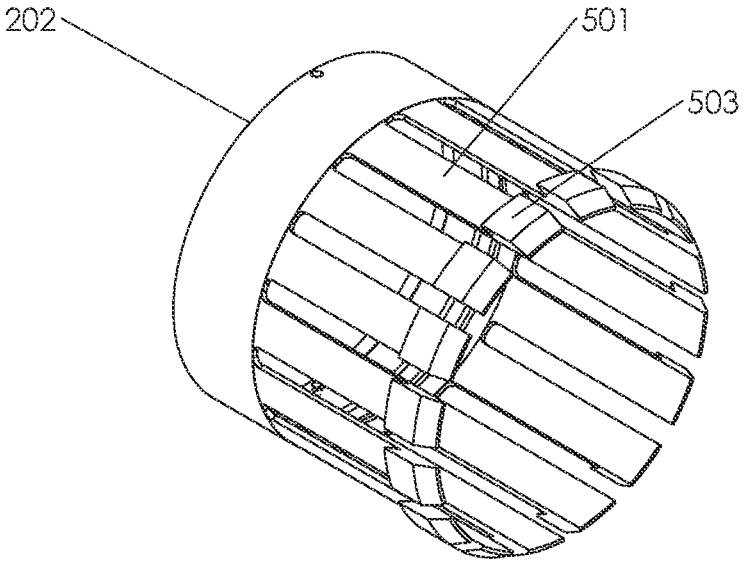
FIGURE 5A
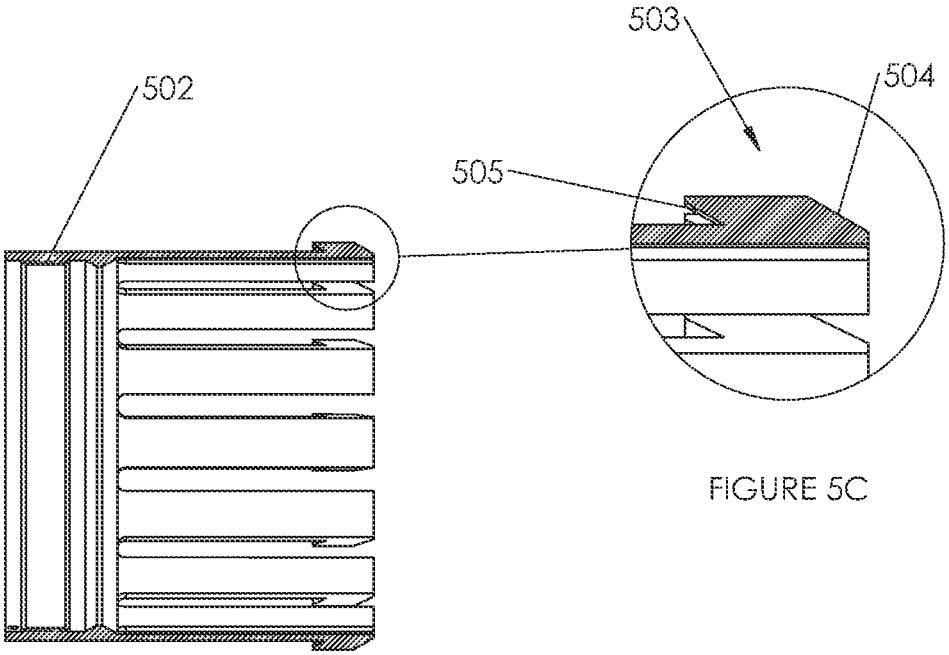
FIGURE 5C
FIGURE 5B

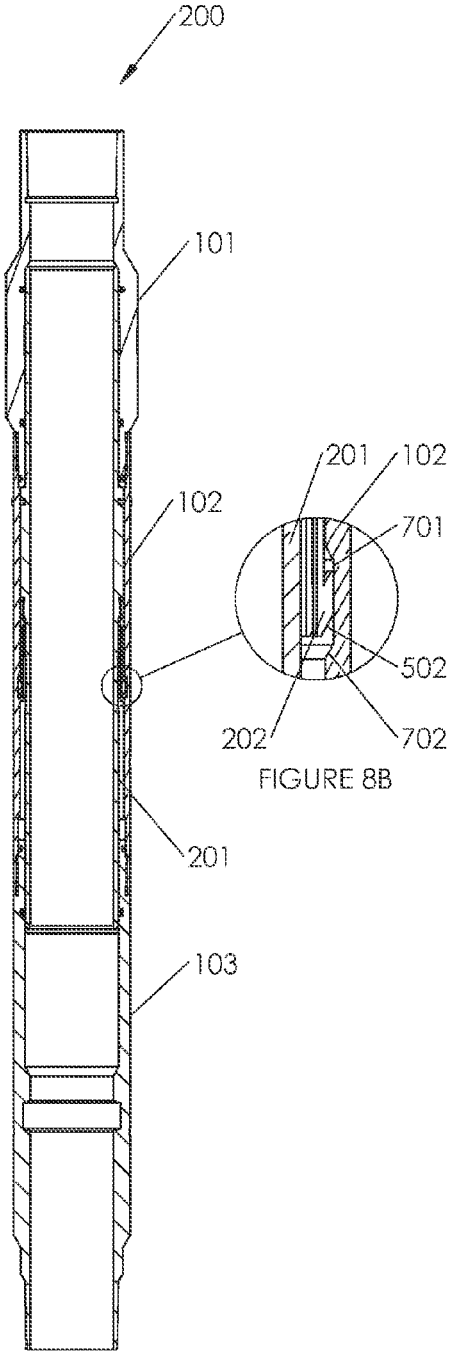
FIGURE 8B
FIGURE 8A
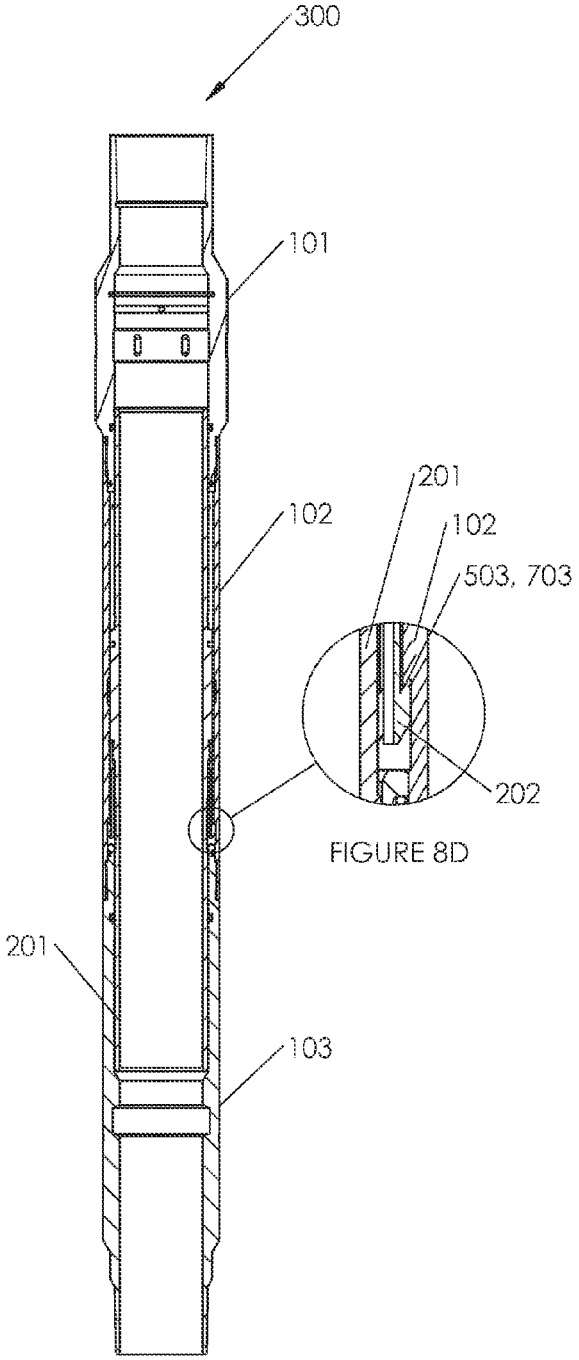
FIGURE 8D
FIGURE 8C 200
201
1002
101
101

105
105
208
1001
105
105
1003
201
101

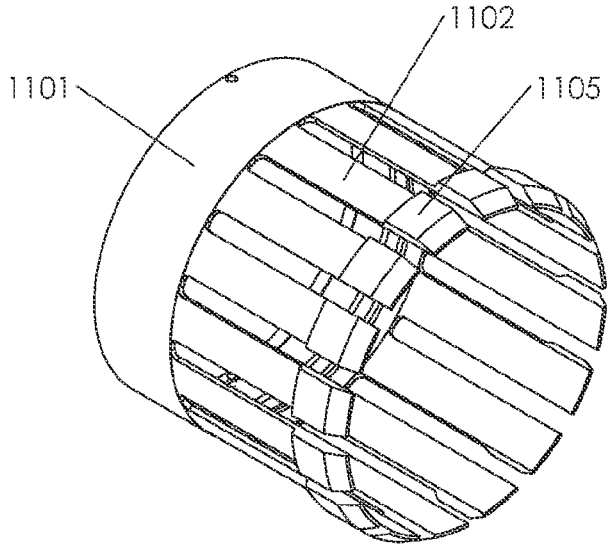
FIGURE 11A
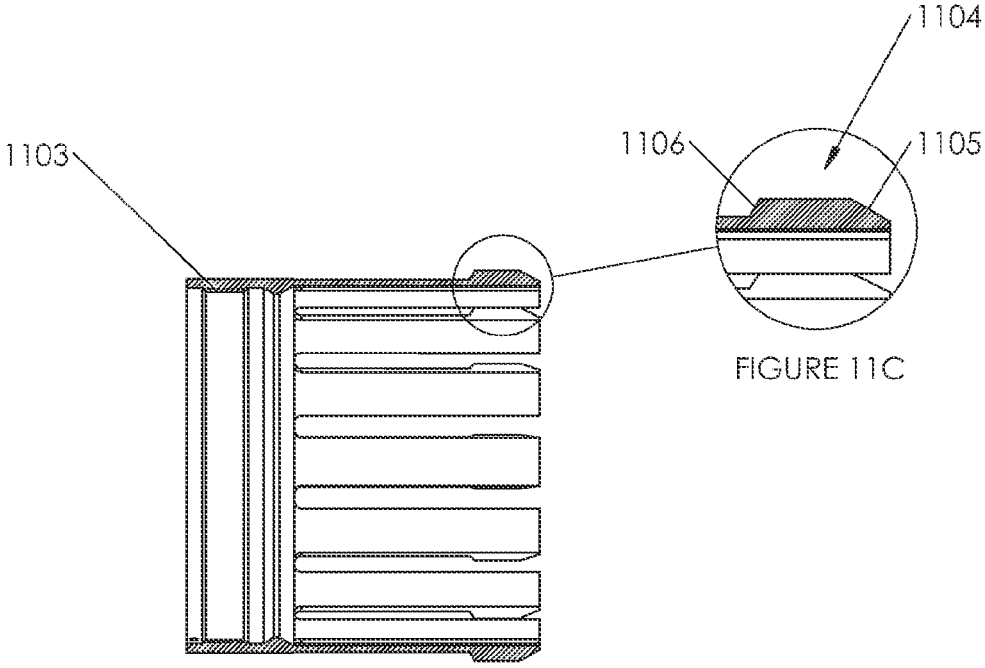
FIGURE 11C
FIGURE 11B

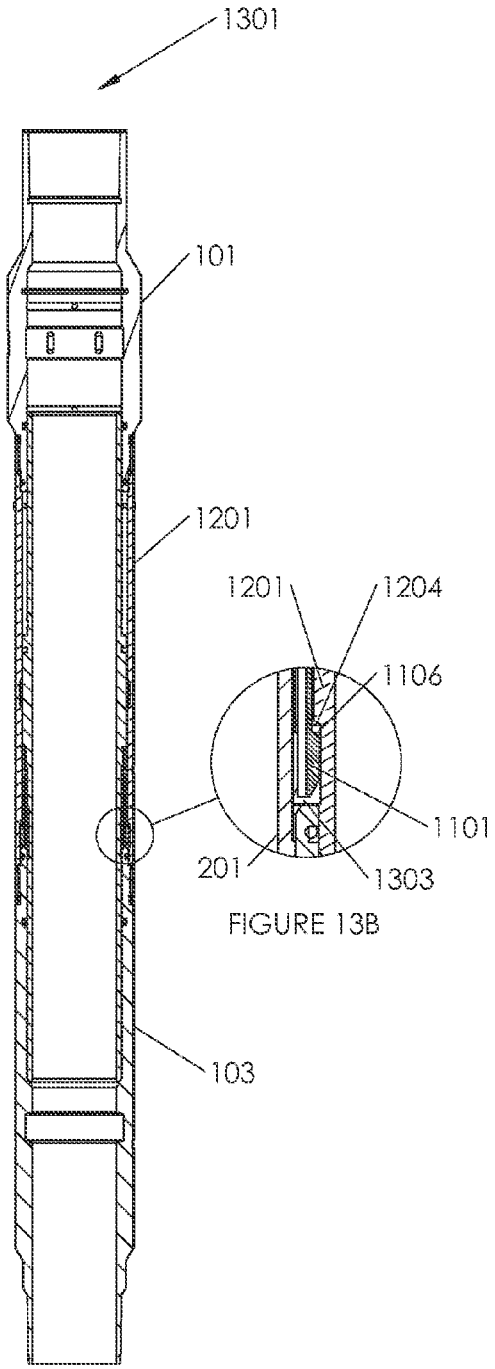
FIGURE 13B
FIGURE 13A
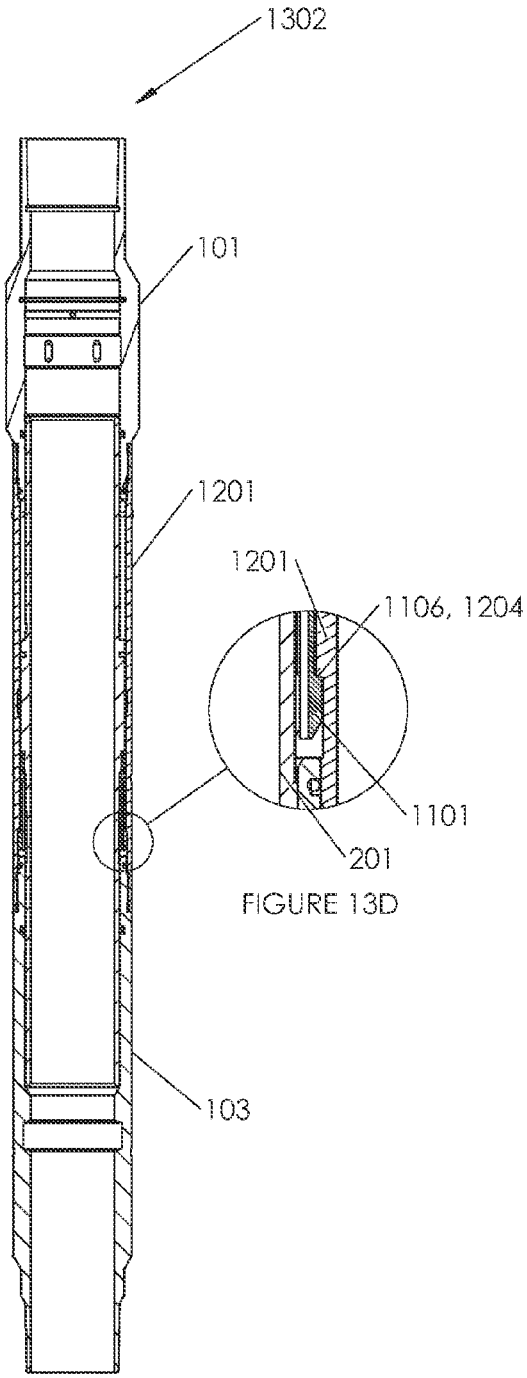
FIGURE 13D
FIGURE 13C

WELL TREATMENT DEVICE, METHOD, AND SYSTEM

BACKGROUND OF INVENTION

1. Technical Field

The invention relates to tools and methods of treatment of well-bores that are used, for example, in the exploration and production of oil and gas. The present invention is related to a device for delivering fluids into a geologic zone in a well. In a particular example, the device is used for hydraulic fracturing, including a method for delivering treatment fluids into a geologic zone in a well. In another example, water may be injected into a zone for the purpose of disposal.

2. Discussion of the Background

Summary of Some Examples of the Invention

In one example, a system is disclosed for selectively treating zones in a cased well-bore, the system including: a downhole tool, having a body, an inner bore therethrough, an inner surface of the body formed by the inner bore, and an outer surface; at least one treatment port disposed on the outer surface of the body; means for selectively isolating the inner bore from the outer surface, the means for selectively isolating the inner bore comprising a sliding sleeve disposed within the inner bore of the body; means for isolating, the means comprising an annular chamber between inner surface of the body and an outer surface of the sliding inner sleeve, the chamber in isolation from the inner bore and the outer surface; means for maintaining the inner sliding sleeve in an open position, the means for maintaining disposed within the annular chamber; and means for maintaining the inner sliding sleeve in a closed position.

In one example, the system further includes: means for holding the inner sliding sleeve in an open position, the means comprising a collet disposed around the outer surface of the inner sleeve; at least one finger on the collet shaped to engage the inner surface for holding the sleeve in an open position; and where the inner surface is shaped at a predetermined location for engagably receiving the collet.

In one example, the means for isolating the annular chamber includes: a first seal disposed in a fixed position on the inner surface of the body, the outer surface of the inner sliding sleeve being slidably disposed on the first seal, the first seal disposed in a position on the inner surface that is longitudinally proximate to a first end of the inner sliding sleeve when the inner sleeve is positioned in the open position; and a second seal disposed in a fixed position on the inner surface of the body, the outer surface of the inner sliding sleeve being slidably disposed on the second seal, the second seal disposed in a fixed position on the inner surface that is longitudinally proximate to a second end of the inner sliding sleeve when the inner sleeve is positioned in the closed position; and where the first seal and the second seal are disposed in longitudinal positions such that the annular chamber maintains isolation when the inner sleeve is positioned in either the open position or in the closed position.

In one example, the system further includes: a seal disposed in a fixed position on the inner surface of the assembly body, the outer surface of the inner sliding sleeve being slidably disposed on the third seal, wherein the third seal is disposed in a fixed position on the assembly body that is longitudinally proximate to the one (first) end of the inner sliding sleeve when the inner sleeve is positioned in the closed position.

In one example, the system further includes means for lubricating the sliding engagement of the outer surface of the inner sleeve with the inner surface of the body, the means for lubricating comprising lubricating ports disposed on the outer surface of the tool, forming an orifice bore to the inner bore of the body, disposed longitudinally between the first and third seals and isolated (not in fluid communication) from communication with the annular (locking) chamber.

In one example, a system is disclosed for selectively treating zones in a cased well-bore, the system including: a downhole tool, having a body, an inner bore therethrough, an inner surface of the body formed by the inner bore, and an outer surface; at least one treatment port disposed on the outer surface of the tool, providing fluid communication between the inner bore the outer surface; means for selectively isolating the inner bore from the outer surface, the means for selectively isolating the inner bore comprising a sliding sleeve disposed within the inner bore, the inner sliding sleeve positioned in a closed position or open position with respect to the at least one treatment port; means for maintaining the inner sliding sleeve in an open position, the means comprising a collet disposed around an outer surface of the inner sleeve; at least one finger on the collet shaped to engage the inner surface for maintaining the sleeve in an open position, the inner surface shaped at a predetermined location for engagably receiving the collet; and means for maintaining the inner sliding sleeve in a closed position.

In one example, a system is disclosed for selectively treating zones in a cased well-bore, the system including: a downhole tool, having a body, an inner bore therethrough, an inner surface of the body formed by the inner bore, and an outer surface; at least one treatment port disposed on the outer surface of the tool, providing fluid communication between the inner bore and the outer surface; means for selectively isolating the inner bore from the outer surface, the means for selectively isolating the inner bore comprising a sliding inner sleeve disposed within the inner bore, the inner sliding sleeve positioned in a closed position or open position with respect to the at least one treatment port; means for maintaining the inner sliding sleeve in a closed position, the means comprising a first groove disposed on the outer surface of the inner sliding sleeve and a shear pin disposed radially through the assembly body into the inner bore, engagable to the first groove; means for holding the inner sliding sleeve in an open position, the means comprising: a compression spring disposed in an inner wall formed by the inner bore, and a locking pin urged against the compression spring and protruding into the inner bore, engagably received by a second groove disposed on the outer surface of the inner sleeve; and where the second groove is disposed longitudinally distal from the first groove, relative to the treatment port.

In one example, the system further includes a means for isolating, the means comprising an annular chamber between the inner surface of the body and the outer surface of the sliding inner sleeve, the chamber in isolation from the inner bore and the outer surface.

In one example, a system is disclosed for selectively treating zones in a cased well-bore, the system including: a downhole tool, having a body, an inner bore therethrough, an inner surface of the body formed by the inner bore, and an outer surface; at least one treatment port disposed on the outer surface of the tool, providing fluid communication between the inner bore the outer surface; means for selectively isolating the inner bore from the outer surface, the means for selectively isolating the inner bore comprising a sliding sleeve disposed within the inner bore, the inner sliding sleeve positioned in a closed position or open position with respect to the at least one treatment port; means for maintaining the inner sliding sleeve in an open position; means for maintaining the inner sliding sleeve in a closed position; and means for lubricating the sliding engagement of the outer surface of the inner sleeve with the inner surface of the body.

In one example, a system is disclosed for protecting treatment ports in a downhole treatment tool, the treatment tool having an outer surface and an inner bore, the inner bore in fluid communication with the outer surface through one or more treatment port orifices disposed on the outer surface of the treatment tool, the system including: a dissolvable treatment port cover disposed in the fluid communication path of the treatment port.

In one example, disclosed is a cover configured to dispose over a treatment port of a downhole treatment tool, the cover comprising a dissolvable material.

In one example, disclosed is a downhole treatment tool collet, the collet including a unitary hollow cylindrical member; one or more individual cantilevered beams having a first end and a second end, the first end of each cantilevered beam disposed on the cylindrical member in longitudinal orientation circumferentially about the axis of the cylindrical member; a compression surface and a locking surface disposed on the second end of each cantilevered beam, the compression surface and the locking surface protruding radially outward relative to the axis of the cylindrical member; and where each cantilevered beam is flexible in a radial direction relative to the axis of the cylindrical member and where each beam is configured to receive a predetermined stress due to an applied inward deflection. In one example, the locking surface is disposed at an angle less than perpendicular relative to the longitudinal axis in the direction of the first end of the beam. In one example, disclosed is a collet and receiving system including the disclosed collet and a retaining groove disposed on an inner surface of a treatment tool where each cantilevered beam includes a locking member disposed on the outer face of the cantilevered beam and where the shape of the retaining groove is matched to fitably receive the one or more cantilevered beams of the collet.

In one example, disclosed is a method for treatment of a well, the method including: locating a treatment tool in a well; setting an activation tool in the well; placing a treatment; unsetting the activation tool; and where the treatment tool includes: a body having an inner bore therethrough, an inner surface of the body formed by the inner bore, and an outer surface; at least one treatment port disposed on the outer surface of the tool, providing fluid communication between the inner bore the outer surface; means for selectively isolating the inner bore from the outer surface, the means for selectively isolating the inner bore comprising a sliding sleeve disposed within the inner bore, the inner sliding sleeve positioned in a closed position or open position with respect to the at least one treatment port; means for maintaining the inner sliding sleeve in an open position; and means for maintaining the inner sliding sleeve in a closed position.

In one example of the method, the treatment tool further includes a means for isolating, the means comprising an annular chamber between inner surface of the body and an outer surface of the sliding inner sleeve, the chamber in isolation from the inner bore and the outer surface. In one example, the annular chamber is a constant volume chamber when the inner sliding sleeve is in any position.

In one example, disclosed is a method for treatment of a well, the method including: locating a treatment tool in a well, the treatment tool having a treatment port and a cover over the treatment port; setting an activation tool in the well; placing a treatment, including applying pressure to rupture cover; unsetting the activation tool.

In one example, disclosed is a method for treatment of a well, the method including: locating a treatment tool in a well, the treatment tool having a treatment port and a dissolvable cover over the treatment port; setting an activation tool in the well; placing a dissolving fluid across the cover; placing a treatment; unsetting the activation tool.

In one example, disclosed is a method for treatment of a well, the method including: locating a treatment tool in a well; setting an activation tool in the well; placing a treatment; unsetting the activation tool; and where the treatment tool comprises: a body having an inner bore therethrough, an inner surface of the body formed by the inner bore, and an outer surface; at least one treatment port disposed on the outer surface of the tool, providing fluid communication between the inner bore the outer surface; means for selectively isolating the inner bore from the outer surface, the means for selectively isolating the inner bore comprising a sliding sleeve disposed within the inner bore, the inner sliding sleeve positioned in a closed position or open position with respect to the at least one treatment port; means for maintaining the inner sliding sleeve in an open position; means for maintaining the inner sliding sleeve in a closed position; means for isolating, the means comprising an annular chamber between inner surface of the body and an outer surface of the sliding inner sleeve, the chamber in isolation from the inner bore and the outer surface; and means for repeatably placing the inner sliding sleeve in an open or closed position, the means comprising a collet disposed around the outer surface of the sliding sleeve and a receiving groove disposed on the inner surface of the body. In one example, the annular chamber is a constant volume chamber when the inner sliding sleeve is in any position.

A system is disclosed for selectively treating zones in a cased well-bore, the system including: a downhole casing assembly housing, having an inner bore therethrough and an outer diameter; a plurality of treatment ports disposed on the outer surface of the assembly; means for selectively isolating the inner bore of the casing assembly from the outer diameter of the assembly, the means for selectively isolating the inner bore comprising a sliding inner pipe sleeve disposed within the inner bore of the assembly; a means for isolating including an annular chamber between the assembly and the sliding inner sleeve, the chamber in isolation from the inner bore of the pipe and the outer diameter of the housing; means for holding the inner sliding sleeve in an open position, the means for holding disposed within the annular chamber (locking chamber); and means for holding inner sliding sleeve in a closed position.

In one example of the invention, disclosed further are means for holding the inner sliding sleeve in an open position, the means comprising a collet (202) disposed around the outer surface of the inner sleeve; a plurality of fingers on the collet (501) shaped to engage the inner diameter wall/surface of the casing assembly housing/body for holding the sleeve in an open position, where the inner diameter wall/surface of the casing assembly/body is shaped at a predetermined location for engagably receiving the collet.

A system is disclosed for selectively treating zones in a cased well-bore, the system including: a downhole casing assembly housing, having an inner bore therethrough and an outer diameter; a plurality of treatment ports disposed on the outer surface of the assembly, providing fluid communication between the inner bore of the assembly and the outer diameter of the assembly housing; means for selectively isolating the inner bore of the casing assembly from the outer diameter of the assembly, the means for selectively isolating the inner bore comprising a sliding pipe sleeve (201) disposed within the inner bore of the assembly, the inner sliding sleeve positioned in a closed position or open position with respect to the treatment ports; means for holding the inner sliding sleeve in an open position, the means comprising a collet (202) disposed around the outer surface of the inner sleeve; a plurality of fingers on the collet (501) shaped to engage the inner diameter wall/surface of the casing assembly housing/body for holding the sleeve in an open position, the inner diameter wall/surface of the casing assembly shaped at a predetermined location for engagably receiving the collet; and means for holding inner sliding sleeve in a closed position.

In a further example, the means for holding in a closed position includes a plurality of shear pins disposed radially through the assembly housing into the inner bore, with engaging grooves disposed on the outer surface of the inner sleeve. In a further example, the means for holding in a closed position comprises a self-sealing shear pin.

A system is disclosed for selectively treating zones in a cased well-bore, the system including: a downhole casing assembly housing (1401/1402), having an inner bore therethrough and an outer diameter; a plurality of treatment ports disposed on the outer surface of the assembly, providing fluid communication between the inner bore of the assembly and the outer diameter of the assembly housing; means for selectively isolating the inner bore of the casing assembly from the outer diameter of the assembly, the means for selectively isolating the inner bore comprising a sliding pipe sleeve (1403) disposed within the inner bore of the assembly, the inner sliding sleeve positioned in a closed position or open position with respect to the treatment ports; means for holding the inner sliding sleeve in a closed position, the means comprising a locking pin shear (first) groove (1501) disposed on the outer surface of the inner sliding sleeve and a shear pin (1404) disposed radially through the assembly housing into the inner bore, engagable to the locking pin shear (first) groove (1501); means for holding the inner sliding sleeve in an open position, the means comprising a compression spring (1603) disposed within the inner wall/surface of the assembly housing/body, a locking pin (1601) urged against the compression spring and protruding into the inner bore of the assembly housing, engagably received by a locking (second) groove (1502) disposed on the outer surface of the inner sleeve. The locking groove is disposed longitudinally distal from the locking pin shear (first) groove, relative to the treatment port. In one example, compression spring (1603) is replaced by pressure provided from outside the assembly housing.

In one example of the invention, means for isolating the annular chamber includes a first seal disposed in a fixed position on the inner surface of the assembly, the outer surface of the inner sliding sleeve being slidably disposed on the first seal, the first seal disposed in a position on the assembly that is longitudinally proximate to one (first) end of the inner sliding sleeve when the inner sleeve is positioned in the open position; and a second seal disposed in a fixed position on the inner surface of the assembly, the outer surface of the inner sliding sleeve being slidably disposed on the second seal, the second seal disposed in a fixed position on the assembly that is longitudinally proximate to the other (second) end of the inner sliding sleeve when the inner sleeve is positioned in the closed position. The seals are disposed in longitudinal positions such that the annular chamber maintains isolation when the inner sleeve is positioned in either the open position or in the closed position.

In one example, the first seal comprises a lip seal disposed in an open-faced outward position with respect to the end of the inner sleeve.

In one example, the second seal comprises a lip seal disposed in an open-faced outward position with respect to the end of the inner sleeve.

In one example, the system further includes a (third) seal disposed in a fixed position on the inner surface of the assembly, the outer surface of the inner sliding sleeve being slidably disposed on the third seal, the third seal disposed in a fixed position on the assembly that is longitudinally proximate to the one (first) end of the inner sliding sleeve when the inner sleeve is positioned in the closed position. In a further example, the third seal is an energized seal ring. In one example, the treatment ports are positioned between the first and third seals.

In one example, the first seal comprises an energized seal ring.

In one example, the second seal comprises an energized seal ring.

In one example, the system includes a means for excluding debris existing outside the assembly housing from entering the treatment port. In one example, the means for excluding includes a cover disposed on the outer diameter of the assembly housing over the treatment port. In one example, the means for excluding includes a cover disposed in the fluid communication path of the treatment port. In one example, the cover is ruptured upon applying pressure from the inner bore of the assembly housing. In one example, the treatment port cover is comprised of a dissolvable material. In one example, the treatment port cover includes means for permeating dissolving solution to both sides of the cover. In one example, the treatment port cover includes one or more orifices. In one example, the means for permeating includes one or more orifices in the treatment cover.

In one example, the system includes means for lubricating the sliding engagement of the outer surface of the inner sleeve with the inner surface of the assembly housing. In one example, the means for lubricating includes lubricating ports disposed on the outer surface of the assembly housing, forming an orifice bore to the inner bore of the housing, disposed longitudinally between the first and third seals and isolated (not in fluid communication) from communication with the annular (locking) chamber. In one example, the lubricating ports include plugs.

In one example, a system is disclosed for protecting treatment ports in a downhole treatment tool, the treatment tool having an outer surface and an inner bore, the inner bore in fluid communication with the outer surface through one or more treatment port orifices disposed on the outer surface of the treatment tool, the system including a dissolvable treatment port cover disposed in the fluid communication path of the treatment port. In one example, the dissolvable cover is dissolvable by a corresponding dissolvent injected through the inner bore and through the treatment port. In one example, the treatment port cover includes means for permeating dissolving solution to both sides of the cover. In one example, the treatment port cover includes one or more orifices. In one example, the means for permeating includes one or more orifices in the treatment cover.

BRIEF DESCRIPTION OF THE DRAWINGS

In the following, preferred embodiments of the invention are depicted with reference to the accompanying Figures, in which:

FIG. 2B shows a cross-sectional detail-view of the Treatment Port Seal Assembly;

FIG. 2C shows a cross-sectional detail-view of the Upper Chamber Seal Assembly;

FIG. 2D shows a cross-sectional detail-view of the Lower Chamber Seal Assembly;

FIG. 2E shows a cross-sectional detail-view of the Shear Screw in Housing;

FIG. 5A shows a 3-D perspective view of one example of the Collet used to lock the Treatment Valve, in the open position;

FIG. 5B shows a Cross-sectional view of one example of the Collet;

FIG. 5C shows a cut-away partial 3-D perspective detail-view of, in one example, the Collet Head;

FIG. 8A shows a cross-sectional view of one example of the treatment valve assembly in the closed position;

FIG. 8B shows a cross-sectional detail-view of one example of the Collet Head positioned in the Housing Collet Relief Groove;

FIG. 8C shows a cross-sectional view of one example of the treatment valve assembly in the open and locked position;

FIG. 8D shows a cross-sectional detail-view of one example of the Collet Head positioned with the Collet Locking Face engaged with the Housing Locking Face;

FIG. 9B shows a cross-sectional detail-view of one example of the Collet Head positioned in the Housing in the shouldered position;

FIG. 9C shows a cross-sectional detail-view of one example of the Inner Sleeve Landing surface urged onto the Bottom Sub Landing Surface in the shouldered position;

FIG. 11A shows a 3-D perspective view of one example of a multi-cycle Collet used to lock and unlock the Treatment Valve, to and from the open position;

FIG. 11B shows a Cross-sectional view of one example of the multi-cycle Collet;

FIG. 11C shows a cut-away partial 3-D perspective detail-view of, in one example, the multi-cycle Collet Head;

FIG. 13A shows a cross-sectional detail-view of one example of a multi-cycle treatment valve assembly with multi-cycle components in the shouldered position;

FIG. 13B shows a cross-sectional detail-view of one example of the Multi-Cycle Collet Head positioned in the Multi-Cycle Housing Collet Relief Groove;

FIG. 13C shows a cross-sectional detail-view of one example of a multi-cycle treatment valve assembly with multi-cycle components in the open and locked position;

FIG. 13D shows a cross-sectional detail-view of one example of the Multi-Cycle Collet Upper Compression Face engaged with the Multi-Cycle Housing Retaining Face;

FIG. 14B shows a cross-sectional detail-view of one example of the Treatment Port Seal Assembly;

FIG. 14C shows a cross-sectional detail-view of one example of the Upper Chamber Seal Assembly;

FIG. 14D shows a cross-sectional detail-view of one example of the Lower Chamber Seal Assembly;

FIG. 14E shows a cross-sectional detail-view of one example of the Locking Pin Mechanism;

DETAILED DESCRIPTION

Figure 1:
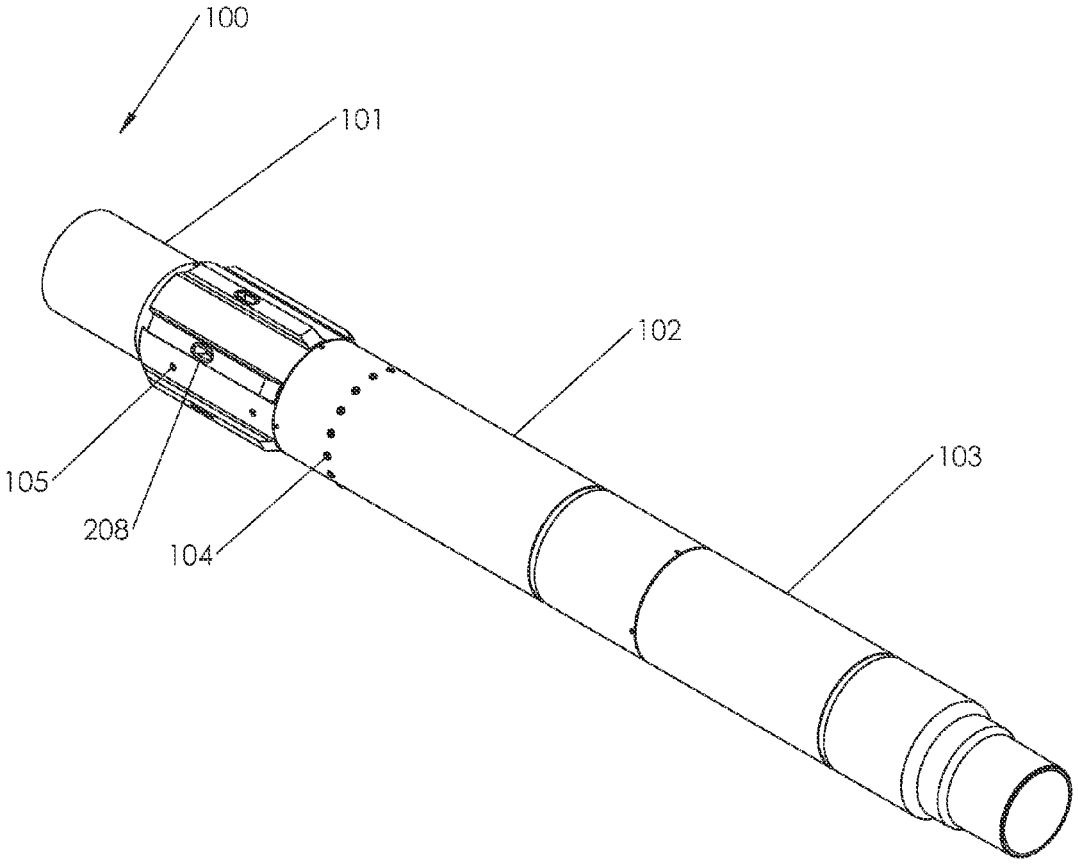
FIG. 1 shows a 3-D perspective external view of the treatment valve assembly incorporating one example of the present invention.

FIG. 1 shows a 3-D perspective external view of the treatment valve assembly incorporating one example of the present invention. FIG. 1 is an external view of the Treatment Valve 100, and shows, in one example, its three major external components. A Ported Top Sub 101 is attached to a Bottom Sub 103 by a Housing member 102. In this example, these components form the tool body. In one example, these parts making up the body of the tool are secured together with threaded connections. Treatment Valve 100 is deployed into the wellbore by placing it in-line with a production string. In one example, this is done by threading Bottom Sub 103 of assembled Treatment Valve 100 into the production string as it is deployed into the wellbore, then threading the production string into Ported Top Sub 101, and continuing to deploy the production string into the wellbore.

Figure 2A:
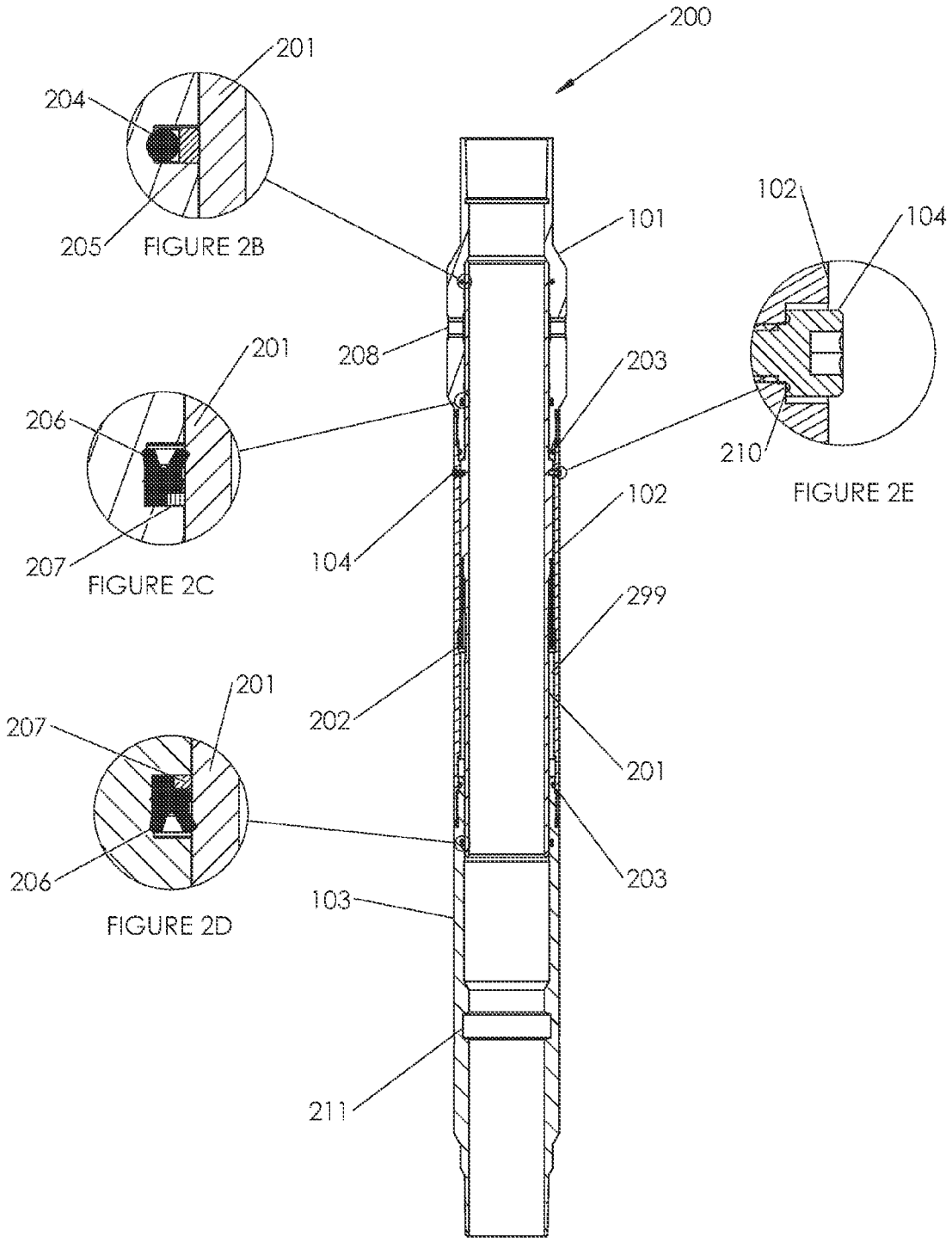
FIG. 2A shows a cross-sectional view of the treatment valve assembly incorporating one example of the present invention in the closed valve position.

An Inner Sleeve 201 (as shown in FIG. 2A) is radially disposed inside Treatment Valve 100 and held in place by Shear Screws 104 which are inserted through and secured to Housing member 102. Shear Screws 104 are used to maintain the position of Inner Sleeve 201 until Treatment Valve 100 is opened. Treatment Port(s) 208 are used to communicate fluids from the inside of the Treatment Valve 100 to the outside, similar in function to perforations that are placed in production strings with explosive charges. In one example, Treatment Port(s) 208 are oval in shape, and in that example the length and width of the Treatment Port 208 determine the flow area and velocity profile of the treatment fluid placed through the Treatment Port(s) 208. In one example, the size and shape of Treatment Port(s) 208 and the number of Treatment Ports 208 are selected to optimize the placement of the treatment fluid into the formation(s). Each formation encountered has unique properties, which may require the size and shape of the Treatment Port(s) 208 to be adjusted to facilitate placing the desired treatment. In one example, Lubrication Ports/Plugs 105 are used to provide lubrication to the actuating parts of the Treatment Valve to increase the reliability of the assembly.

FIG. 2A shows a cross-sectional view of the treatment valve assembly incorporating one example of the present invention in the closed valve position. FIG. 2A is a cross-sectional view of the assembled Treatment Valve 100 in the closed position (denoted as Treatment Valve 200), as it is run into the wellbore. An Inner Sleeve 201, runs the length of the Treatment Valve 200 from the Treatment Port Seal Assembly as shown in FIG. 2B, to the Lower Chamber Seal Assembly as shown in FIG. 2D. In one example, Inner Sleeve 201 serves two functions in this position. First, it isolates the inside of Treatment Valve 200 from the outside of the Treatment Valve 200 by isolating Treatment Port 208. Second, it is the inner member that forms the inner wall of the Locking Chamber, 299. A Collet 202 is radially disposed on the outside of the Inner Sleeve 201 and, in one example, is used to maintain the Treatment Valve in the open position. Examples of Collet 202, and its function are further detailed in FIGS. 5A-C, 6A-E, 8A-D, 9A-D. Orings 203 are placed to seal the threaded connection at the Ported Top Sub 101 and Housing 102 and the threaded connection at Housing 102 and Bottom Sub 103. In one example, a Locator Groove 211 is placed radially inward in Bottom Sub 103, located longitudinally near the bottom of the sub, and, in one example, is used to provide a means of locating the sleeve. A mechanical collar locator is known in the art as a means of locating upsets in wellbore tubulars, and can be used to locate the treatment valve assembly (the tool) by catching in Locator Groove 211.

FIG. 2B shows a cross-sectional detail-view of the Treatment Port Seal Assembly. FIG. 2B shows the Treatment Port Seal Assembly which is radially disposed of inwardly in Ported Top Sub 101, located longitudinally above the Treatment Port 208 and is comprised of an Energizing Ring, 204 and a Seal Ring 205 which seals on Inner Sleeve 201. In one example, Energizer Ring 204 is a Viton oring and Seal Ring 205 is a carbon filled Teflon ring. This seal assembly is capable of holding pressure in both directions, which is to say that it will maintain the isolation of the inside and outside of the Treatment Valve 100, regardless of which pressure is higher. In one example, Seal Ring 205 seals on the outside diameter of Inner Sleeve 201 and is well-suited for this application because it will not roll or be pulled out of the seal groove when pressure is applied and when Inner Sleeve 201 is shifted downward. In one example, Seal Ring 205 provides the required seal by being forced onto Inner Sleeve 201. Due to practical limitations in machining, Energizer Ring 204 is used to provide the force to engage the seal properly. In typical oring seals, the oring is compressed, which forces it onto the two parts being sealed; however, typical oring seals are known to roll in the groove and/or pull out of the groove when a part is moved under pressure. In a preferred embodiment, two individual seals, Seal Ring 205 and Energizer Ring 204, combine into the seal assembly (shown in FIG. 2B) to yield a seal that is much better suited to the application of the Treatment Valve 100.

FIG. 2C shows a cross-sectional detail-view of the Upper Chamber Seal Assembly. FIG. 2C shows the Upper Chamber Seal Assembly which is radially disposed of inwardly with the open face of the seal oriented upward in Ported Top Sub 101, located longitudinally below the Treatment Port 208, and is comprised of a Lip Seal 206 and a Backup Ring, 207. In one example, Lip Seal 206 is a Viton seal and Backup Ring 207 is a Moly Glass Teflon Ring. In one example, Lip Seal 206 seals on Inner Sleeve 201 and is capable of holding pressure in only one direction. In examples, lip seals are available in a variety of configurations and offered under a variety of commercial names, such as, lip seals and U cup seals. A predominate, defining characteristic of this type of seal is an open face elastomeric feature that is oriented towards the applied pressure. In examples, an energizer is placed in the open face to force the lip onto the part being sealed. Example energizers include springs, orings and X rings. Backup Ring 207 is placed on the low pressure side of the seal, and, in one example, is used to provide additional support to Lip Seal 206, increasing the working pressure of the seal. Elastomeric seals are susceptible to extrusion, which is to say they push out into the gap between the parts being sealed. A seal will not hold the applied pressure and/or will interfere with the movement of the parts of the assembly when the seal extrudes through a gap to a point where it no longer is compressed onto the parts or is pulled out of the seal groove when the sealing parts are moved. Implementing a backup ring, for example Backup Ring 207, provides additional support for the elastomeric seal by limiting the gap between the parts being sealed. In one preferred example, the lip seal configuration is particularly suited for this application because it is a pressure energized design, meaning that applied pressure to the open face acts to further engage Lip Seal 206 on Inner Sleeve 201. In this example, a primary function of the seal is to isolate Locking Chamber 299 from the external wellbore pressure on the outside of Treatment Valve 100.

FIG. 2D shows a cross-sectional detail-view of the Lower Chamber Seal Assembly. In one example, the Lower Chamber Seal is radially disposed of inwardly with the open face of the seal oriented downward in the Bottom Sub 103 and located longitudinally near the top of the Bottom Sub 103 where it will engage Inner Sleeve 201 while Treatment Valve 100 is in the closed position 200. In one example, the Lower Chamber Seal is comprised of the same components as the Upper Chamber Seal for the same functionality.

FIG. 2E shows a cross-sectional detail-view of the Shear Screw in Housing. FIG. 2E shows Shear Screw 104 engaged in both Housing member 102 and Inner Sleeve 201. In one example, Shear Screw 104 is placed radially on the exterior of Housing member 102 and is located longitudinally near the top where it can engage a Shear Screw Groove 601 of the Inner Sleeve 201. Shear Screw 104 is used to maintain Inner Sleeve 201 in the closed position until a predetermined downward force is applied to Inner Sleeve 201, thus shearing the screws and allowing relative movement of Inner Sleeve 201 inside Treatment Valve 100. Shear Screw(s) 104 used, in one example, are self sealing. In one example, an Oring Seal 210 is affixed to Shear Screw 104, in a groove, and provides isolation in both directions. In one example, Oring Seal 210 in made of Viton. It is important to note that in one preferred example, the seal is maintained even after the screw itself is sheared during operation.

In one example, Locking Chamber 299 is an annular region of the tool where features related to retaining Treatment Valve 100 in the desired closed and locked positions are located. In one example of Treatment Valve 100, the Locking Chamber 299 is sealed from all wellbore fluids and associated debris to ensure that the locking features remain free of debris to enhance the reliability of operation. In one example, Locking Chamber 299 is constructed such that it is a constant-volume chamber, meaning that the volume of the chamber does not change when Treatment Valve 100 (inner sliding sleeve 201) is moved through its various positions. In one example, Locking Chamber 299 is defined by four major components: Ported Top Sub 101, Housing member 102, Bottom Sub 103, and Inner Sleeve 201. The exterior surface of Inner Sleeve 201 defines an inner wall of the annular area and the combination of the interior surface walls of Ported Top Sub 101, Housing member 102, and Bottom Sub 103 define an outer wall of the annular area. The annular region is sealed on the up-hole end by the Upper Chamber Seal Assembly, as shown in FIG. 2C, and the Oring 203 at the threaded connection of Ported Top Sub 101 and Housing member 102. The down-hole end of Locking Chamber 299 is sealed by the Lower Chamber Seal, as shown in FIG. 2D, and the other Oring 203 at the threaded connection of Housing member 102 and Bottom Sub 103. In one example, the final seal(s) isolating Locking Chamber 299 include an Oring Seal 210, located on Shear Screw(s) 104.

In one example of Treatment Valve 100, this chamber is an atmospheric chamber, meaning that the pressure in Locking Chamber 299 is maintained at the atmospheric pressure when the tool was assembled. This can result in particularly high pressure differentials across the Upper and Lower Chamber Seals, as shown in FIGS. 2C and 2D. Consequently, the pressure energized design of Lip Seal 206 utilized in the Upper and Lower Chamber Seals, as shown in FIGS. 2C and 2D, is considered to greatly improve the overall reliability of Treatment Valve 100.

Figure 3:
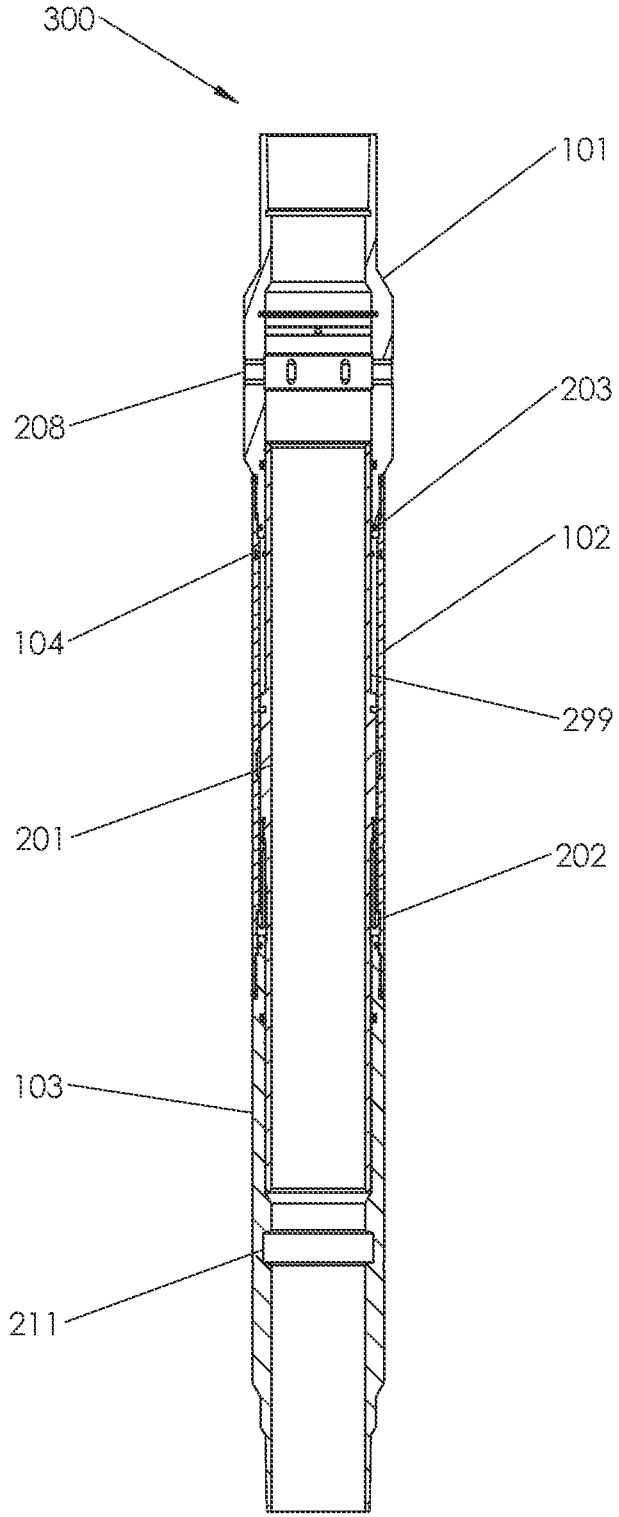
FIG. 3 shows a cross-sectional view of the treatment valve assembly incorporating one example of the present invention in the open and locked position.

FIG. 3 shows a cross-sectional view of the treatment valve assembly (the tool) incorporating one example of the present invention in the open and locked position. In one example, the FIG. 3 cross-sectional view of the assembled Treatment Valve 100, in the open and locked position 300, is the final position of Treatment Valve 100 after being actuated and the treatment placed. This position is attained by applying a downward force to Inner Sleeve 201 which is sufficient to shear Shear Screw(s) 104. Once Shear Screw(s) 104 are sheared, Inner Sleeve 201 moves down and disengages the Treatment Port Seal Assembly, as shown in FIG. 2B, exposing Treatment Ports 208. Treatment Ports 208 are exposed to provide fluid access to the reservoir behind the production string, and communicate the inside of the production string to the fluids in the reservoir. This communication enables both placing the treatment and producing the reservoir.

Figure 4A:
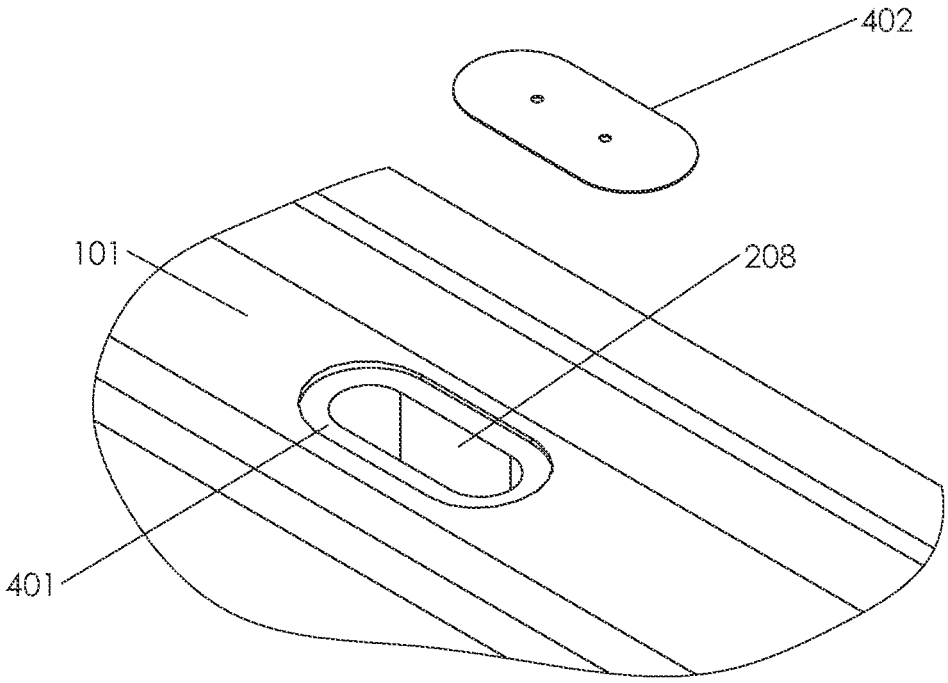
FIG. 4A shows a cut-away partial 3-D perspective view of, in one example, the exterior of the treatment valve assembly, detailing the Treatment Port, Treatment Port Recess and Treatment Port Cover prior to placement.

FIG. 4A shows a cut-away partial 3-D perspective view of, in one example, the exterior of the treatment valve assembly, detailing the Treatment Port, Treatment Port Recess and Treatment Port Cover prior to placement. FIG. 4A shows a detailed view of Treatment Port 208 and Treatment Port Cover 402, which is used to shield Treatment port 208 from debris while being run in the wellbore and maintaining the lubrication of the valve. Also shown in FIG. 2A is a Treatment Port Recess 401 in which Treatment Port Cover 402 is placed.

Figure 4B:
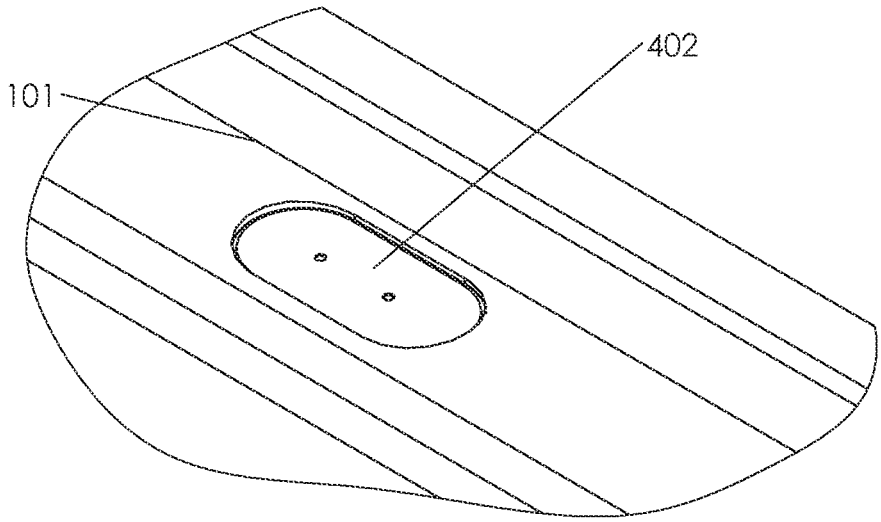
FIG. 4B shows a cut-away partial 3-D perspective view of, in one example, the exterior of the treatment valve assembly, detailing the Treatment Port Cover installed in the Treatment Port Recess, over the Treatment Valve.

FIG. 4B shows a cut-away partial 3-D perspective view of, in one example, the exterior of the treatment valve assembly (the tool), detailing the Treatment Port Cover installed in the Treatment Port Recess, over the Treatment Valve. FIG. 4B shows Treatment Port Cover 402 placed in Treatment Port Recess 401. In one example, Treatment Port Cover 402 is adhered to Treatment Port Recess 401 by a suitable adhesive or solder. While being run in the wellbore, Treatment Valve 100 will be in contact with the wellbore or other tubular walls in both a sliding and rotating motion; therefore, in one example, Treatment Port Recess 401 is important because it protects Treatment Port Cover 402 from being pulled off Treatment Valve 100 due to contact with the wellbore or other tubulars in which it is conveyed through. In one example, the treatment port cover thickness and material combination provide a limited strength that can be ruptured by applying pressure from fluids pumped from the inner bore. In a preferred example, Treatment Port Cover 402 is constructed from a material that is dissolvable by a fluid that is compatible with the formation. In one example, the dissolvable fluid is selected from those fluids that are capable of dissolving the cover and yet are non-damaging to the wellbore formation of interest. In one example, the dissolving fluid is 15% Hydrochloric Acid. In one example, the treatment port cover thickness and material combination provide a limited strength that can be ruptured, after applying the dissolving fluid, by applying pressure from fluids pumped from the inner bore. In one example, Treatment Port Cover 402 is constructed of aluminum and, in further example, is 0.007 inch thick with, in further example, two 1/16 inch holes placed on the centerline. In one example, the holes placed in Treatment Port Cover 402 facilitate contact of the dissolving fluid with Treatment Port Cover 402, in one example, by preventing a dead volume. In one example, Treatment Port Cover 402 is constructed, positioned, and arranged to keep debris out of the valve actuation area. In one example, Treatment Port Cover 402 is constructed, positioned, and arranged to maintain the lubrication placed in Treatment Valve 100, at surface, which is introduced through Lubrication Port/Plug(s) 105.

FIG. 5A shows a 3-D perspective view of one example of the Collet used to lock the Treatment Valve in the open position. FIG. 5A is an overall view of Collet 202 which is used to lock Treatment Valve 100 in the open position 300. In one example, Collet 202 is a cylindrical component that is constructed to create individual Collet Fingers 501 which, in one example, is comprised of sixteen individual Collet Fingers 501, in one example, disposed in longitudinal orientation circumferentially about the axis of the collet. In one example, Collet 202 is a hollow cylindrical member. In one example, Collet 202 is a unitary cylindrical member. Collet 202 is shaped, positioned, and arranged to allow it to slide through Housing member 102, which, in one example, has a smaller inside diameter than the outside diameter of Collet 202. In one example, this is accomplished by machining individual Collet Fingers 501, which can be viewed as individual cantilevered beams that will deflect under load. This deflection allows Collet Finger 501 to deflect inward and pass through a smaller diameter restriction of Housing 102 and spring back to the original outside diameter past the restriction. In one example, an additional feature of Collet 202 is that is can support longitudinal loads once engaged in a suitable retaining groove.

In one example, the length, width and thickness of Collet Fingers 501 are selected to match its operational requirements, as these parameters determine the stress induced in individual Collet Fingers 501 when deflected inward while shifting the Treatment Valve 100. The combination of those characteristics and the yield strength of the material used to construct Collet 202 are selected to ensure that Collet Finger 501 is flexible enough to spring back after being compressed, which is to say that the stress due to the applied inward deflection does not exceed the yield strength of the material used to construct Collet 202. In one example, Collet Finger 501 is of substantial enough strength to withstand the longitudinal loads applied during operation.

FIG. 5B shows a Cross-sectional view of one example of the Collet. FIG. 5B shows the Collet Thread 502, used to fix Collet, 202 to Inner Sleeve 201 at Inner Sleeve Thread 602.

FIG. 5C shows a cut-away partial 3-D perspective detail-view of, in one example, the Collet Head 503. A Collet Compression Face 504 is used to compress the collet in the downward movement by contacting Housing Compression Face 702. In one example, Compression Face 504 is a surface on the free end of the cantilevered beam (finger), the compression surface forming part of the head that protrudes radially outward relative to the axis of the collet. Collet Locking Face 505 is machined to match a Housing Locking Face 703 in Housing member 102, preventing Treatment Valve 100 from closing after being opened. In one example, Locking Face 505 is a surface on the free end of the cantilevered beam (finger), the locking surface forming part of the head that protrudes radially outward relative to the axis of the collet. In one example, the locking surface is disposed with a negative rake, for example, disposed at an angle less than 90 degrees from the longitudinal axis and in the direction of the first end of the beam, as illustrated in FIG. 5C. In one example, Collet Locking Face 505 has an angle of 30 degrees, for example, 30 degrees from the longitudinal axis and in the direction of the first end of the beam. In one example, to simplify machining, Collet Locking Face 505 has an angle of 35 degree, for example, 35 degrees from the longitudinal axis and in the direction of the first end of the beam.

In one example, the term collet refers to the physical appearance of the member, but does not necessarily require the collet member to squeeze the inner sleeve for secure holding. Rather, in one example, the collet member is secured to the inner sleeve by other means, such as threads, and the collet member functions to provide outwardly expanding fingers to urge stops, or locking faces, outward towards the inner surface wall of the assembly housing or body. The fingers are compressible radially inwards, allowing locking faces to be longitudinally inserted in position, longitudinally past diameter restrictions on the inner face of the assembly housing/body.

Figure 6A:
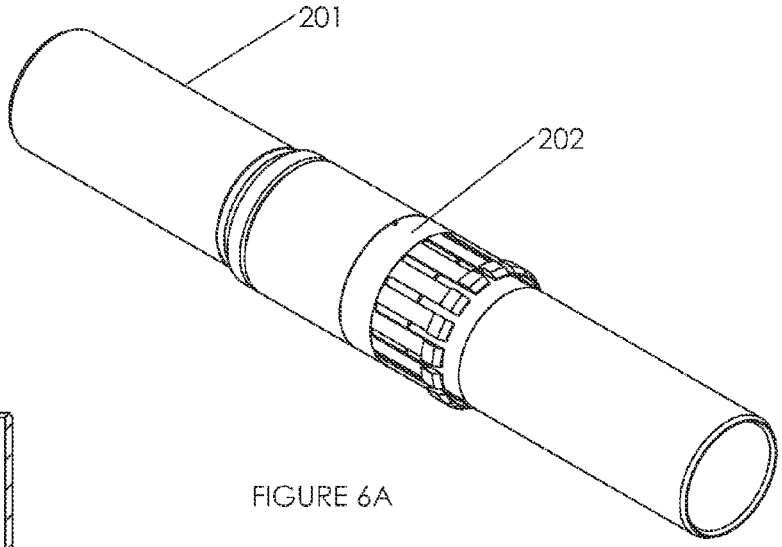
FIG. 6A shows a 3-D perspective external view of one example of the Collet installed on the Inner Sleeve.

FIG. 6A shows a 3-D perspective external view of one example of the Collet installed on the Inner Sleeve. Collet 202 is shown installed on Inner Sleeve 201. Collet 202 is placed radially on Inner Sleeve 201, longitudinally located on an Inner Sleeve Thread 602, with Collet Head(s) 503 oriented downward from Threads 502 and 602.

Figure 6B:
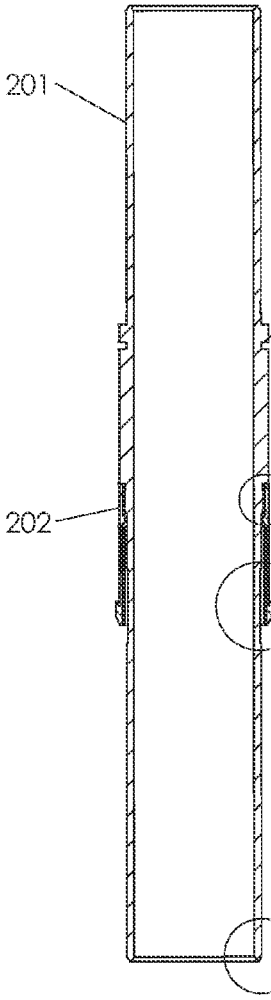
FIG. 6B shows a cross-sectional view of one example of the Collet installed on the Inner Sleeve.

FIG. 6B shows a cross-sectional view of one example of the installed on the Inner Sleeve. Collet 202 is shown installed on Inner Sleeve 201. A Shear Screw Groove 601 is a groove radially placed on Inner Sleeve 201, placed longitudinally such that Shear Screws 104, inserted and retained in Housing 102, can be engaged.

Figure 6C:
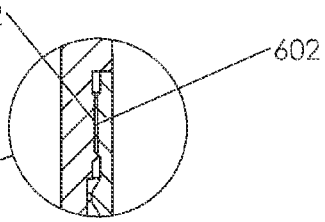
FIG. 6C shows a cross-sectional detail-view of one example of threads affixing the Collet to the Inner Sleeve.

FIG. 6C shows a cross-sectional detail-view of one example of threads affixing the Collet to the Inner Sleeve. Threads 502 and 602, as shown are used to affix Collet 202 to Inner Sleeve 201.

Figure 6D:
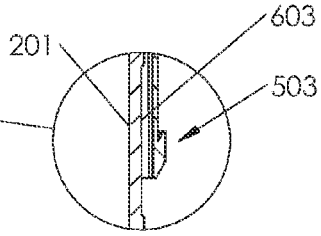
FIG. 6D shows a cross-sectional detail-view of one example of the Collet Head positioned over an Inner Sleeve Collet Relief Groove.

FIG. 6D shows a cross-sectional detail-view of one example of the Collet Head positioned over an Inner Sleeve Collet Relief Groove. Collet Head 503, as shown, is located on Inner Sleeve 201. The Inner Sleeve Collet Relief Groove 603 is a small relief placed on the exterior of Inner Sleeve 201 to allow for proper deflection of Collet Head 503 as it is compressed while moving longitudinally through Housing 102, such that Collet Head 503 does not contact Inner Sleeve 201 as the Treatment Valve 100 is moved from the closed position.

Figure 6E:
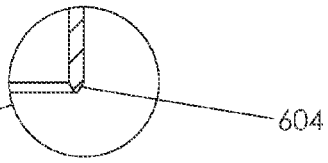
FIG. 6E—shows a cross-sectional detail-view of one example of the Inner Sleeve Landing Surface.

FIG. 6E—shows a cross-sectional detail-view of one example of the Inner Sleeve Landing Surface. An Inner Sleeve Landing Surface 604 is shown on Inner Sleeve 201, in one example, is used to limit the movement of Inner Sleeve 201 within Treatment Valve 100. Inner Sleeve Landing Surface 604 will come in contact with the Bottom Sub Landing Surface 901. In one example, Inner Sleeve Landing Surface 604 forms a contact shoulder against Bottom Sub Landing Surface 901 to limit further longitudinal movement of Inner Sleeve 201.

Figures 7A, 7B:
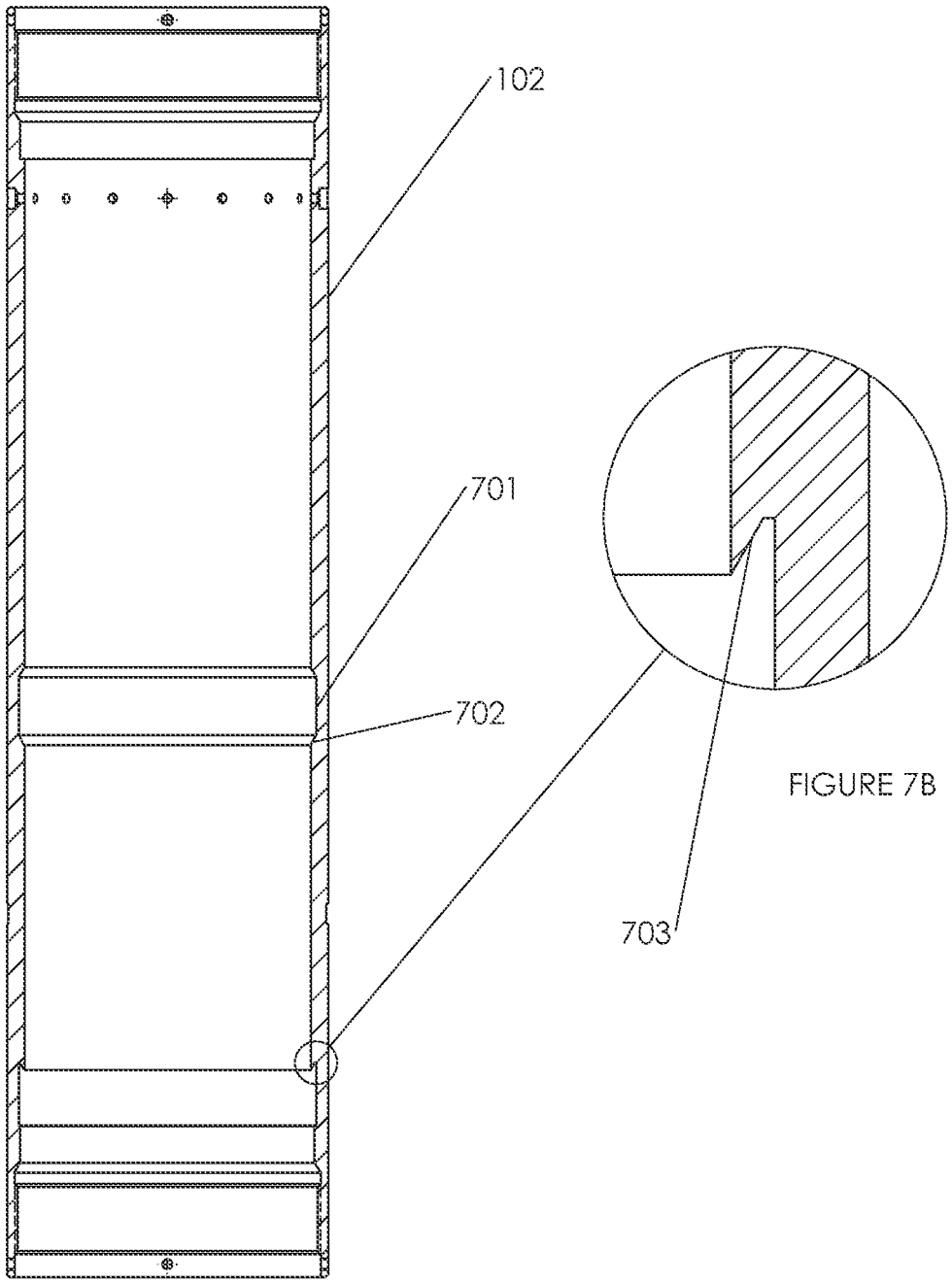
FIG. 7A shows a cross-sectional view of one example of the treatment assembly Housing member.
FIG. 7B shows a cross-sectional detail-view of one example of the Housing Locking Face.

FIG. 7A shows a cross-sectional view of one example of the treatment assembly Housing member. Housing member 102 is shown with detail of a Housing Collet Relief Groove 701, which is a groove placed into Housing member 102, allowing Collet Finger(s) 501 (as shown in FIG. 5A) to be in a non-stressed state while Treatment Valve 100 is in the closed position 200. In one example, the placement of Collet Head 503 in Housing Collet Relief Groove 701 is shown in FIG. 8B. A Housing Collet Compression Face 702 is shown, which acts on Collet Compression Face 504 (as shown in FIG. 5C) to bend Collet Finger(s) 501 (not shown) as the Treatment Valve, 100, is moved from the closed position, 200.

FIG. 7B shows a cross-sectional detail-view of one example of the Housing Locking Face. A Housing Locking Face 703 is matched to Collet Locking Face 505 (shown in FIG. 5C) to prevent Treatment Valve 100 from closing after actuation. The interaction of the two locking faces are further discussed using FIGS. 8D and 9B.

FIG. 8A shows a cross-sectional view of one example of the treatment valve assembly in the closed position. Treatment Valve 100 in the closed position 200 is included to show the location of Collet Head 502 relative to the treatment valve assembly in the closed position 200.

FIG. 8B shows a cross-sectional detail-view of one example of the Collet Head positioned in the Housing Collet Relief Groove. Collet Head 503 is shown disposed in Housing Collet Relief Groove 701, when Treatment Valve 100 is in the closed position, 200. This relief groove allows the Collet to be placed in the assembly without stressing the Collet Finger(s) 501. As Treatment Valve 100 is moved from the closed position 200, Collet Compression Face 504 contacts Housing Compression Face 702, forcing Collet Finger(s), 501 to deflect radially inward.

FIG. 8C shows a cross-sectional view of one example of the treatment valve assembly in the open and locked position. Treatment Valve 100, in the open and locked position 300, is included to show the location of Collet Head 503 relative to the treatment valve assembly in the open and locked position, 300.

FIG. 8D shows a cross-sectional detail-view of one example of the Collet Head positioned with the Collet Locking Face engaged with the Housing Locking Face. Collet Head 503 is shown disposed in Housing member 102, when the Treatment Valve 100 is in the open and locked position 300. Collet Locking Face 505 is in contact with Housing Locking Face 703. These two faces are in contact and, in one example, the 30 degree angle at which they are placed in the assembly prevent the Treatment Valve 100 from closing. An upward force placed on the Inner Sleeve 201 is transmitted to Collet 202 by the thread engagement at Collet Threads 502 and Seal Threads 602. This force is further transmitted through Collet Finger 501, and then to Housing member 102 by the engagement of Collet Locking Face 505 and Housing Locking Face 703, thus preventing Treatment Valve 100 from closing. The angle of the locking faces act to lock Treatment Valve 100 by preventing Collet Finger(s) 501 from deflecting inward when an upward force is applied to Inner Sleeve 203.

Figure 9A:
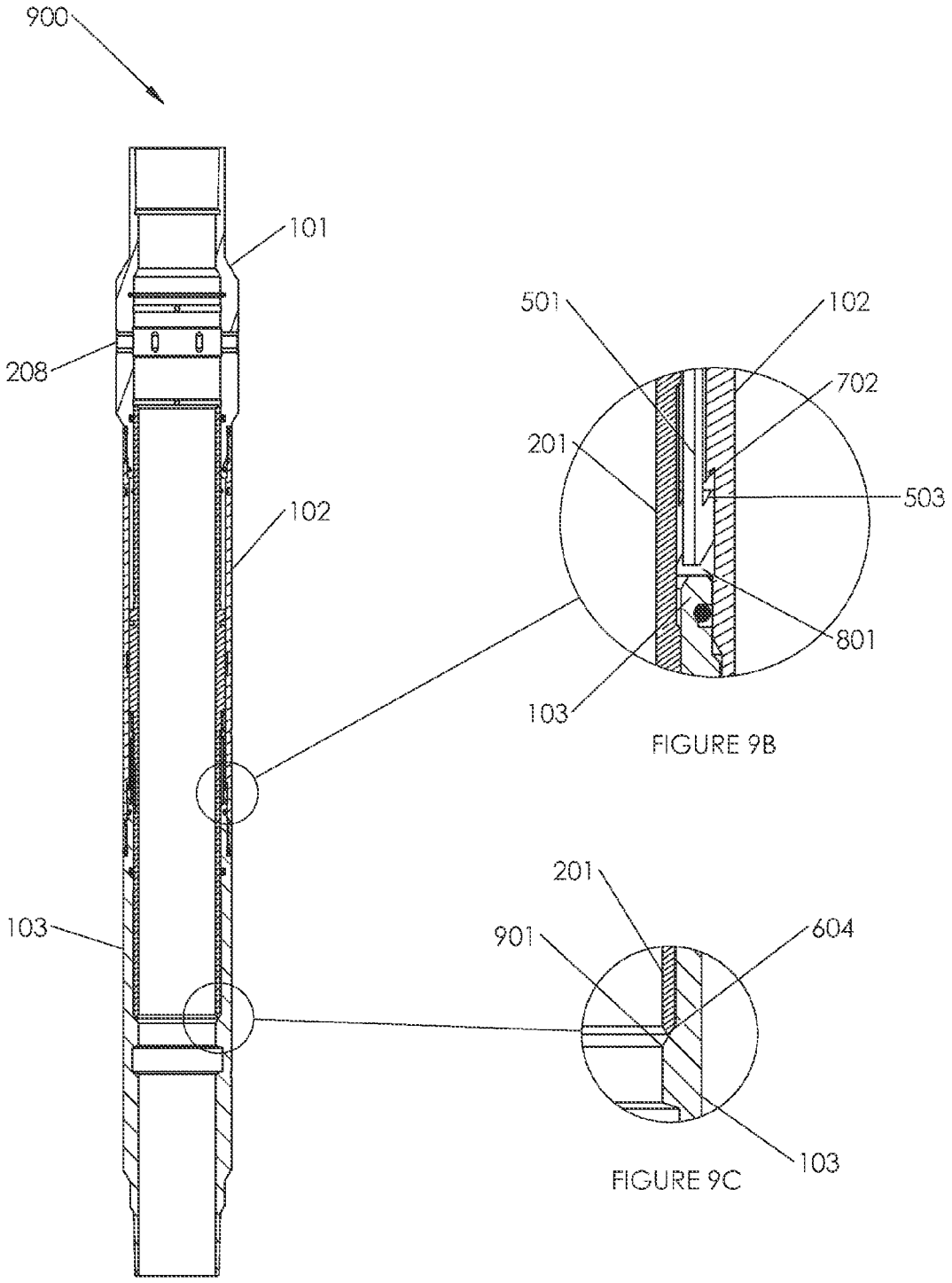
FIG. 9A shows a cross-sectional view of one example of the treatment valve assembly in the shouldered position.

FIG. 9A shows a cross-sectional view of one example of the treatment valve assembly in the shouldered position. Treatment Valve 100, in the shouldered position 900, is included to show the location of Collet Head 503 relative to the treatment value assembly in the shouldered position 900. In one example, shouldered position 900 is defined by the contact of Inner Sleeve 201 and Bottom Sub 103, which prevents any further movement in the downward direction. Shouldered is meant to describe an arrangement where the two parts are touching but are not locked together.

FIG. 9B shows a cross-sectional detail-view of one example of the Collet Head positioned in the Housing in the shouldered position. Collet Head 503 is shown disposed in Housing member 102 when the Treatment Valve 100 is in the shouldered position, 900. A Collet-Bottom Sub Gap 801 is formed by the space between Collet Head 503 and Bottom Sub 103. The shouldered position 900 is achieved when Inner Sleeve 201 comes in contact with Bottom Sub 103 and prevents further downward movement of Inner Sleeve 201 in Treatment Valve, 100. This position is important because, in one example, Collet Finger(s) 501 are slender items that cannot support significant longitudinal compression loading. If Collet Finger(s) 501 were to be loaded in compression longitudinally it is likely they would buckle and preventing Collet Locking Face 505 from engaging Housing Locking Face 703 and/or damage Collet Finger(s) 501, preventing them from being able to support an upward load applied to Inner Sleeve 201. If either of these two conditions existed, the Treatment Valve 100 could close after opening.

FIG. 9C shows a cross-sectional detail-view of one example of the Inner Sleeve Landing surface urged onto the Bottom Sub Landing Surface in the shouldered position. In one example, Inner Sleeve 201 shoulders onto Bottom Sub 103. The engagement occurs at an Inner Sleeve Shouldering Face 604 and a Bottom Sub Shouldering Face 901. The interaction of these two faces achieves the shouldered position 900 of Treatment Valve 100 and prevents any compression loading and subsequent damage of Collet Finger(s) 501 (not shown). In one example, the shouldered faces are placed at 60 degree angles.

Figures 10A, 10B, 10C, 10D, 10E:
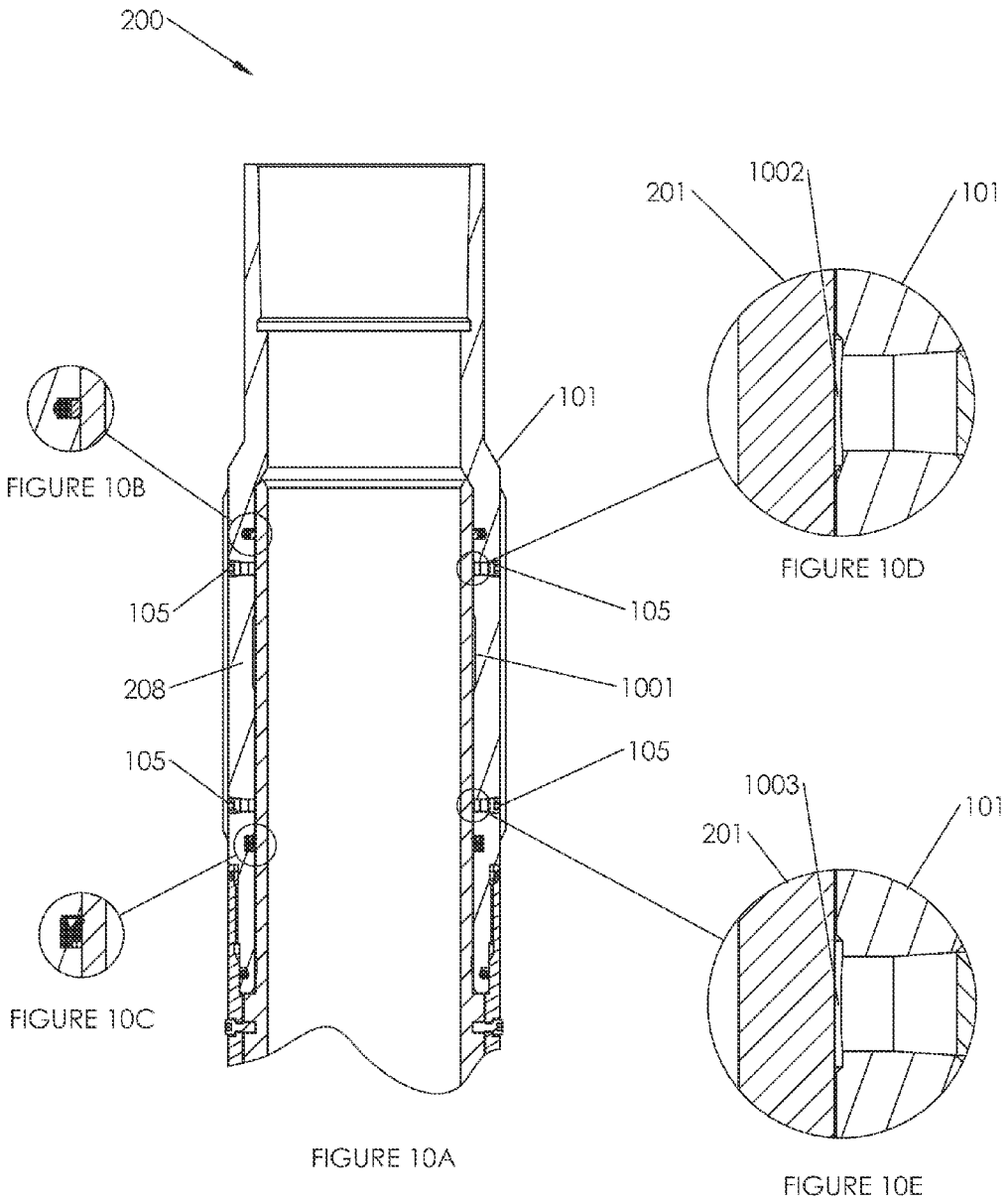
FIG. 10A shows a partial cross-sectional view of one example of the treatment valve assembly in the closed position detailing the Lubricated Region.
FIG. 10B shows a cross-sectional detail-view of one example of the Treatment Port Seal Assembly.
FIG. 10C shows a cross-sectional detail-view of one example of the Upper Chamber Seal Assembly.
FIG. 10D shows a cross-sectional detail-view of one example of the Upper Lubrication Groove.
FIG. 10E shows a cross-sectional detail-view of one example of the Lower Lubrication Groove.

FIG. 10A shows a partial cross-sectional view of one example of the treatment valve assembly in the closed position detailing the Lubricated Region. In one example, a Lubricated Region 1001 is an annular region defined by the exterior surface of Inner Sleeve 201 and the interior surface of Ported Top Sub 101, between the Treatment Port Seal Assembly shown in FIG. 10A and the Upper Chamber Seal Assembly shown in FIG. 10B.

FIG. 10B shows a cross-sectional detail-view of one example of the Treatment Port Seal Assembly. FIG. 10B is a detail view of the Treatment Port Seal Assembly, which, in this example, is identical to FIG. 2B, and is included here to describe the upper boundary of Lubricated Region 1001.

FIG. 10C shows a cross-sectional detail-view of one example of the Upper Chamber Seal Assembly. FIG. 10C is a detail view of the Upper Chamber Seal Assembly, which, in this example, is identical to FIG. 2C, and is included here to describe the lower boundary of Lubricated Region 1001.

FIG. 10D shows a cross-sectional detail-view of one example of the Upper Lubrication Groove. In one example, an Upper Lubrication Groove 1002 is placed radially around the inside diameter of Ported Top Sub 101 and is located longitudinally below the Treatment Port Seal Assembly as shown in FIG. 10B, and longitudinally above Treatment Port 208. In one example, Upper Lubrication Groove 1002 provides a low resistance channel for a lubricant that is to be introduced around the entire circumference of the Inner Sleeve. In one example, the lubricant is grease that does not cause damage to the formation or interact in the treatment fluid in a manner that causes a change to the fluid properties that would prevent a successful treatment. In one example, the lubricant is introduced to the lubrication groove, and subsequently the valve, through one or more of Lubrication Ports 105. In one example, after the lubricant is introduced via Lubrication Port 105, the port is sealed with a cap or plug. In one example, the lubricant is formulated to operate as a debris barrier. An added benefit of the lubrication acting as a barrier is that it prevents debris from entering this area of Treatment Valve 100 and, when used in conjunction with Treatment Port Cover 402, ensures that the lubricant remains in place and fully prevents large debris from fouling Treatment Valve 100.

FIG. 10E shows a cross-sectional detail-view of one example of the Lower Lubrication Groove. In one example, a Lower Lubrication Groove 1003 is placed radially around the inside diameter of Ported Top Sub 101 and is located longitudinally above the Upper Chamber Seal Assembly as shown in FIG. 10C, and longitudinally below Treatment Port 208. In one example, the function of Lower Lubrication Groove 1003 is equivalent to that of Upper Lubrication Groove 1002, as described with FIG. 10D.

FIG. 11A shows a 3-D perspective view of one example of a multi-cycle Collet used to lock and unlock the Treatment Valve, to and from the open position. In one example, a Multi-Cycle Collet 1101 is matched with a compatible Multi-Cycle Housing 1201, allowing Treatment Valve 100 to be placed selectively into the open and closed positions a number of times. In one example, Multi-Cycle Collet 1101 is a cylindrical component constructed to create individual Collet Fingers 1102 which, in one example, is comprised of sixteen individual Collet Fingers 1102. In one example, Multi-Cycle Collet 1101 is shaped, positioned, and arranged to allow it to slide through Multi-Cycle Housing 1201, which has a smaller inside diameter than the outside diameter of Multi-Cycle Collet 1101. This is accomplished by machining individual Collet Fingers 1102, which can be viewed as individual cantilevered beams that will deflect under load. This deflection allows Collet Finger 1102 to deflect inward and pass through a smaller diameter of Multi-Cycle Housing 1201 and spring back to the original outside diameter. In one example, an additional feature of Multi-Cycle Collet 110 is that its composition, shape, position, and arrangement of fingers are designed to support longitudinal loads once engaged in a suitable retaining groove.

In one example, the length, width and thickness of Collet Finger 1102 are selected to match its operational requirements, as these parameters determine the stress induced in individual Collet Fingers 1102 when deflected inward while shifting the Treatment Valve 100. The combination of those characteristics and the yield strength of the material used to construct Multi-Cycle Collet 1101 are selected to ensure that Collet Finger 1102 is flexible enough to spring back after being compressed, which is to say that the stress due to the applied inward deflection does not exceed the yield strength of the material used to construct Multi-Cycle Collet 1101. In one example, Collet Finger 1102 is of substantial enough strength to withstand the longitudinal loads applied during operation.

FIG. 11B shows a Cross-sectional view of one example of the multi-cycle Collet. In one example, a Collet Thread 1103 is used to fix Multi-Cycle Collet 1101 to Inner Sleeve 201 (not shown).

FIG. 11C shows a cut-away partial 3-D perspective detail-view of, in one example, the multi-cycle Collet Head. A Multi-Cycle Collet Head 1104 is disposed on Multi-Cycle Collet 1101. In one example, a Lower Collet Compression Face 1105 is disposed on Multi-Cycle Collet Head 1104 and is used to compress the collet in the downward movement as Treatment Valve 100 is opened. In one example, an Upper Collet Compression Face 1106 is used to compress the collet in the upward movement as Treatment Valve 1302 (shown in FIG. 13C) is closed.

Figures 12A, 12B:
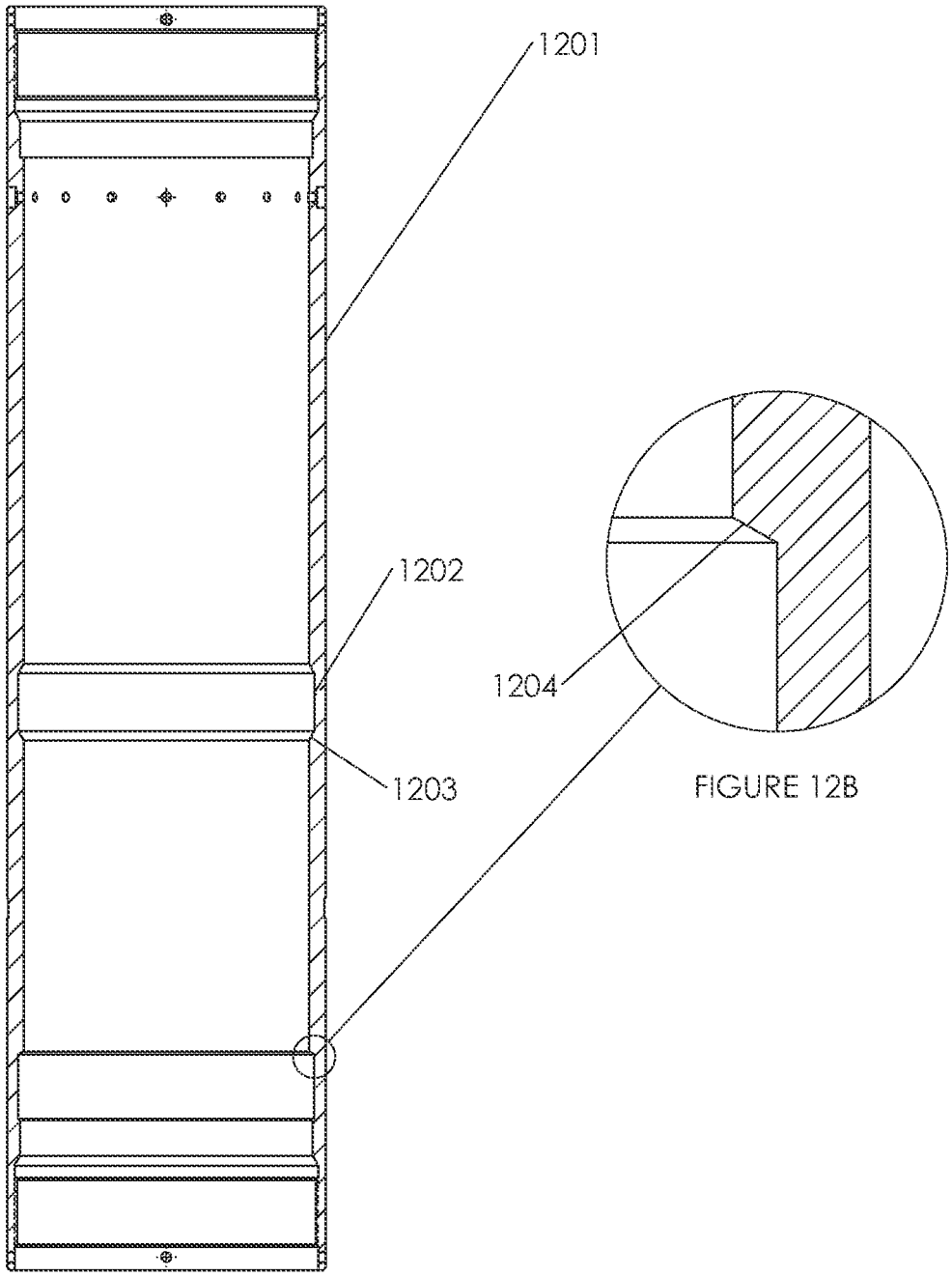
FIG. 12A shows a cross-sectional view of one example of the treatment valve assembly Housing for multi-cycle use.
FIG. 12B shows a cross-sectional detail-view of one example of multi-cycle Housing Open Retaining Face.

FIG. 12A shows a cross-sectional view of one example of the treatment valve assembly Housing for multi-cycle use. In one example, a Multi-Cycle Housing Collet Relief Groove 1202 is a groove placed into the Multi-Cycle Housing 1201, which allows Multi-Cycle Collet Finger(s) 1102 (shown in FIG. 11A) to be in a non-stressed state while Treatment Valve 100, is in the closed position 200. The placement of Multi-Cycle Collet Head 1104 in Housing Collet Relief Groove is shown in FIG. 13B. Also shown is Multi-Cycle Housing Collet Compression Face 1203, which acts on Lower Multi-Cycle Collet Compression Face 1105 (shown in FIG. 11C) to bend Multi-Cycle Collet Finger(s) 1102 (shown in FIG. 11A) as Treatment Valve 100 is moved from the closed position 1301.

FIG. 12B shows a cross-sectional detail-view of one example of multi-cycle Housing Open Retaining Face. In one example, a Multi-Cycle Housing Open Retaining Face 1204 is matched to Upper Multi-Cycle Collet Compression Face 1106 (one example shown in FIG. 11C) to prevent Treatment Valve 100 from closing after actuation. The interaction of the two faces are further discussed using, and in the descriptions for, FIGS. 13C and 13D.

FIG. 13A shows a cross-sectional detail-view of one example of a multi-cycle treatment valve assembly with multi-cycle components in the shouldered position. In one example, a Treatment Valve 100 is shown in the shouldered position with Multi-Cycle components 1301. In one example, this position is equivalent as that shown in FIG. 8A with Collet 202 replaced with Multi-Cycle Collet 1101 and Housing member 102 replaced with Multi-Cycle Housing 1201.

FIG. 13B shows a cross-sectional detail-view of one example of the Multi-Cycle Collet Head positioned in the Multi-Cycle Housing Collet Relief Groove. In one example, Multi-Cycle Collet 1101 is shown in relation to Bottom Sub 103 and Multi-Cycle Housing 1201 with Treatment Valve 100 in position 1301. In one example, a Multi-Cycle Collet Bottom Sub Gap 1303 is a standoff between the two components that prevent Multi-Cycle Collet Fingers 1102 from being loaded in compression, preventing, in one example, possible damage to Multi-Cycle Collet Fingers 1102. Also shown are Upper Multi-Cycle Collet Compression Face 1106 and Multi-Cycle Housing Retaining Face 1204. In one example, Multi-Cycle Housing Retaining Face 1204 and Multi-Cycle Collet Upper Compression Face 1106 are oriented at 60 degrees.

FIG. 13C shows a cross-sectional detail-view of one example of a multi-cycle treatment valve assembly with multi-cycle components in the open and locked position. In one example, Treatment Valve 100 is in the open position with Multi-Cycle components 1302. This position is equivalent as that shown in FIG. 8C with Collet 202 replaced with Multi-Cycle Collet 1101 and Housing member 102 replaced with Multi-Cycle Housing 1201.

FIG. 13D shows a cross-sectional detail-view of one example of the Multi-Cycle Collet Upper Compression Face engaged with the Multi-Cycle Housing Retaining Face. In one example, Multi-Cycle Collet 1101 is shown in relation to Multi-Cycle Housing 1201, with the Treatment Valve 100 in position 1302. Upper Multi-Cycle Collet Compression Face 1106 is shown in contact with Multi-Cycle Housing Retaining Face 1204. In this position, any further upward movement of Inner Sleeve 201 requires force sufficient to compress Multi-Cycle Collet 1101. In one example, the angle of Upper Multi-Cycle Collet Compression Face 1106 and Multi-Cycle Housing Retaining Face 1204, along with the composition, thickness, width and length of Multi-Cycle Collet Finger(s) 1102, determine the force required to compress Multi-Cycle Collet 1101, allowing movement of Inner Sleeve 201 to close Treatment Valve 100.

Figure 14A:
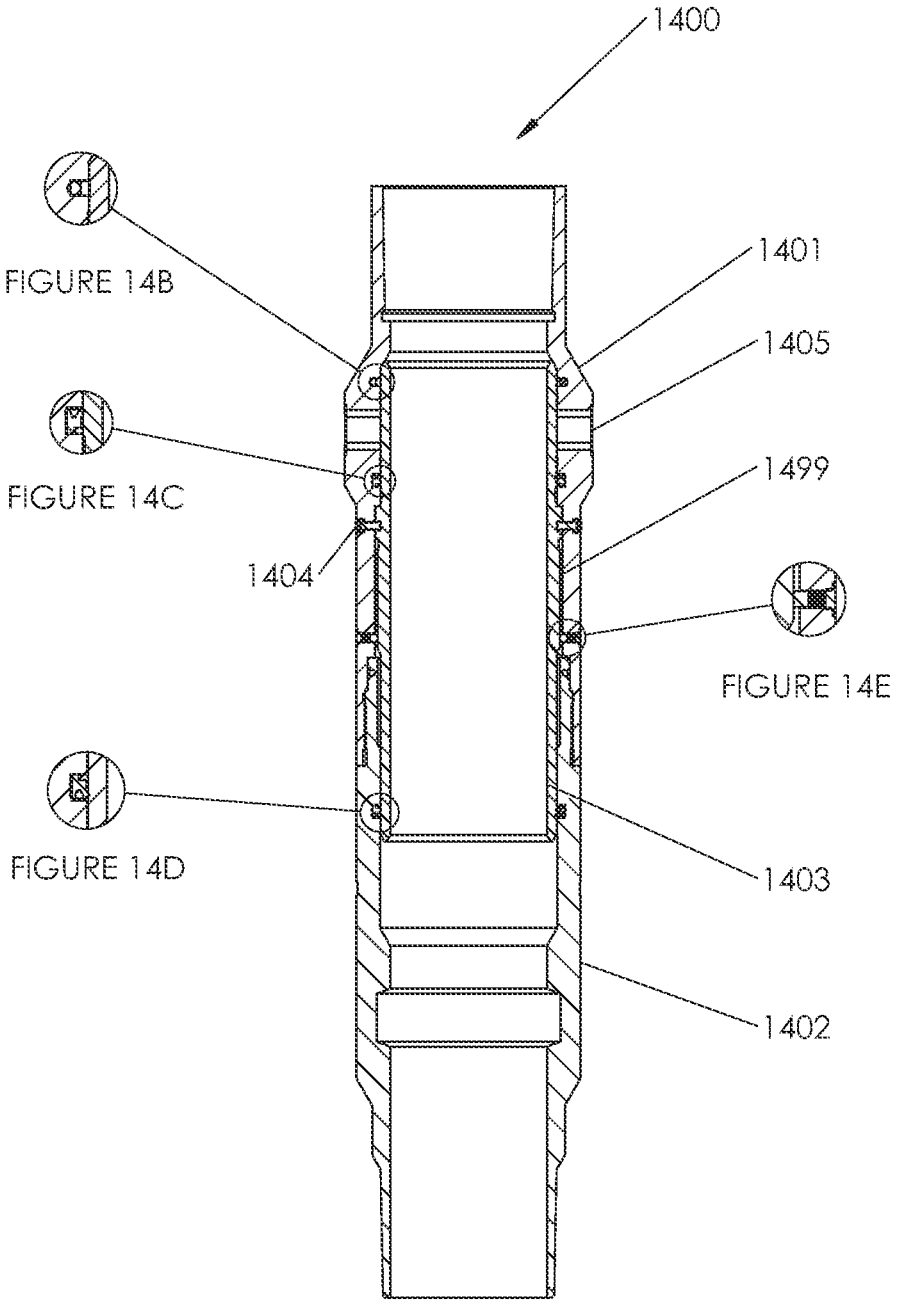
FIG. 14A shows a cross-sectional view of one example of the treatment valve assembly configured to use locking pins.

FIG. 14A shows a cross-sectional view of one example of the treatment valve assembly configured to use locking pins. In one example, a Locking Pin Treatment Valve in the closed position 1400, is shown as is an alternate example of Treatment Valve 100. In one example, one or more Locking Pins 1601 and one or more Locking Pin Spring Stacks 1603 are used to replace the function of Collet 202. In one example, major components of Locking Pin Treatment Valve 1400 include: a Locking Pin Ported Top Sub 1401, a Locking Pin Bottom Sub 1402, and a Locking Pin Inner Sleeve 1403. In this example, Locking Pin Ported Top Sub 1401 and Locking Pin Bottom Sub 1402 form the tool body. Locking Pin Top Sub 1401 and Locking Pin Bottom Sub 1402 are secured together with a threaded connection. In one example, Locking Pin Treatment Valve 1400 is deployed into a wellbore by placing it in-line with a production string. In one example, this is done by threading Locking Pin Bottom Sub 1402 of the assembled Locking Pin Treatment Valve 1400 into the production string as it is deployed into the wellbore, then threading the production string into Locking Pin Ported Top Sub 1401, and continuing to deploy the production string into the wellbore.

In one example, a Locking Pin Inner Sleeve 1403 is radially disposed inside Treatment Valve 1400 and held in place by Shear Screw(s) 1404 which are inserted through Locking Pin Ported Top Sub 1401. Shear Screw(s) 1404 are used to maintain the position of Locking Pin Inner Sleeve 1403 until Locking Pin Treatment Valve 1400 is opened. In one example, Lubrication Ports/Plugs (in one example, similar to those shown in FIG. 1) are used to provide lubrication to the actuating parts of Locking Pin Treatment Valve 1400 to increase the reliability of the assembly. In one example, the Lubrication Ports/Plugs are located and functionally equivalent to Lubrication Ports/Plugs 105, as described in FIGS. 10A, 10D and 10E.

In one example, Locking Pin Inner Sleeve 1403 runs the length of Locking Pin Treatment Valve 1400, from the Treatment Port Seal Assembly as shown in FIG. 14B, to the Lower Chamber Seal Assembly as shown in FIG. 14D. The Locking Pin Inner Sleeve 1403 serves two functions in this position. First, it isolates the inside of Treatment Valve 1400 from the outside of the Treatment Valve 1400 by isolating Treatment Port 1405. Second, it is the inner member that forms the inner wall of Locking Chamber 1499. In one example, Locking Chamber 1499 is equivalent in function and location as Locking Chamber 299, which is described in detail in FIGS. 2A, 2B, 2C, 2D and 2E. In one example, another Oring Seal 1702 is used on Retaining Screw 1701 to seal Locking Chamber 1499.

FIG. 14B shows a cross-sectional detail-view of one example of the Treatment Port Seal Assembly. FIG. 14B shows an example of the Treatment Port Seal Assembly, which is equivalent in function and location to the Treatment Port Seal Assembly shown and described in FIG. 2B.

FIG. 14C shows a cross-sectional detail-view of one example of the Upper Chamber Seal Assembly. FIG. 14C shows an example of the Upper Chamber Seal Assembly, which is equivalent in function and location to the Upper Chamber Seal Assembly shown and described in FIG. 2C.

FIG. 14D shows a cross-sectional detail-view of one example of the Lower Chamber Seal Assembly. FIG. 14D shows the Lower Chamber Seal Assembly, which is equivalent in function and location to the Lower Chamber Seal Assembly shown and described in FIG. 2D.

FIG. 14E shows a cross-sectional detail-view of one example of the Locking Pin Mechanism. FIG. 14E is a detailed view of the locking mechanism employed in Locking Pin Treatment Valve 1400. The individual components and operation of the locking mechanism are described in detail in FIGS. 15, 16, 17 and 18.

Figure 15A:
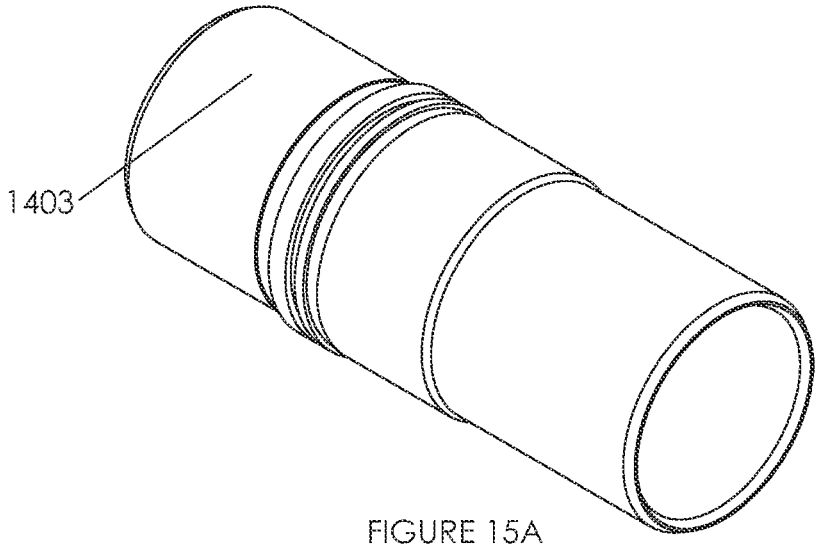
FIG. 15A shows a 3-D perspective external view of one example of the Locking Pin Inner Sleeve.

FIG. 15A shows a 3-D perspective external view of one example of the Locking Pin Inner Sleeve. FIG. 15A is an overall view of Locking Pin Inner Sleeve 1403, which is used to isolate Locking Pin Treatment Ports 1404, and embodies features to retain Locking Pin Inner Sleeve 1403 in various positions during operation.

Figure 15B:
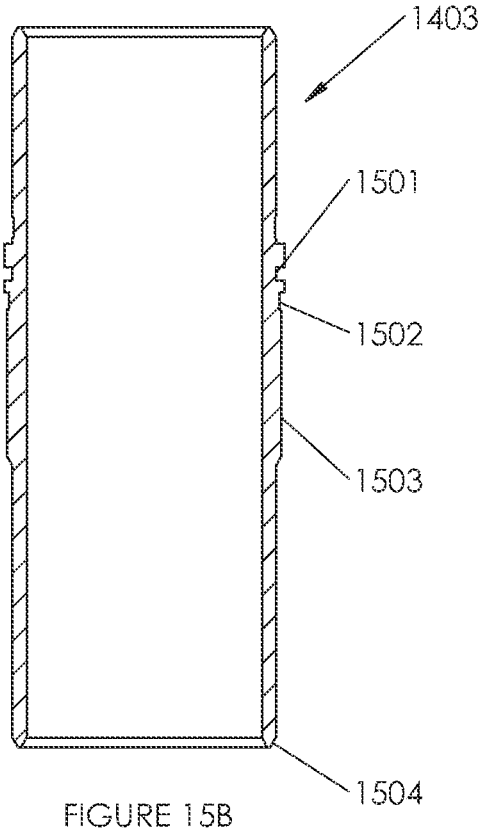
FIG. 15B shows a cross-sectional view of one example of the Locking Pin Inner Sleeve.

FIG. 15B shows a cross-sectional view of one example of the Locking Pin Inner Sleeve. FIG. 15B is a cross-sectional view of Locking Pin Inner Sleeve 1403 and shows the details of features used to maintain the longitudinal position of Locking Pin Inner Sleeve 1403 in the various desired positions. A Locking Pin Shear Screw Groove 1501 is located near the top of Locking Pin Inner Sleeve 1403 and is located such that Shear Screw(s) 1404, inserted through Locking Pin Ported Top Sub 1401, can engage the groove. In one example, a Locking Groove 1502 is located longitudinally below Locking Pin Shear Screw Groove 1501 and is used to engage Locking Pin 1601 (as detailed in one example in FIGS. 17A and 17B). In one example, a Locking Pin Running Surface 1503 is located longitudinally below Locking Pin Groove 1502 and is the surface that Locking Pin 1601 rides on while Locking Pin Treatment Valve is moved from the closed position 1400 to the open and locked position 1800. In one example, a Locking Pin Inner Sleeve Landing Shoulder 1504 is equivalent in function and location to Inner Sleeve Landing Shoulder 604.

Figure 16A:
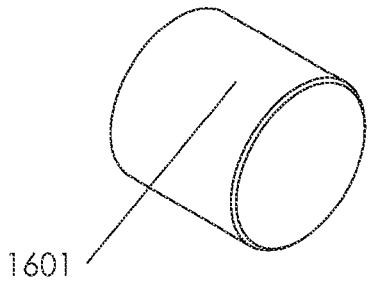
FIG. 16A shows a 3-D perspective external view of one example of the Locking Pin.

FIG. 16A shows a 3-D perspective external view of one example of the Locking Pin. In one example, a Locking Pin 1601 is used to engage Locking Pin Groove 1502. In one example, Locking Pin 1601 is a cylindrical member. The functionality of the Locking Pin in the overall locking mechanism are further discussed using, and in the descriptions for, FIGS. 17B and 18B.

Figure 16B:
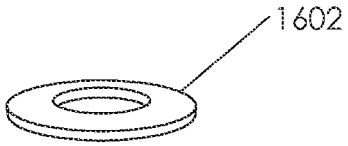
FIG. 16B shows a 3-D perspective external view of one example of the Belleville Disc Spring.

FIG. 16B shows a 3-D perspective external view of one example of the Belleville Disc Spring. In one example, a Belleville Disc Spring is used for Locking Spring 1602. A Belleville Disc Spring is a specially formed washer that deflects when loaded in compression, much like a typical compression spring. One of the advantages of the design is that Belleville Disc Springs typically provide spring constants larger than those attainable with wire wrapped springs of the same diameter. Another advantage of Belleville Disc Springs is that they can be stacked in a variety of combinations to yield the desired deflection, or an increase in working load, or a combination of the two. One example of stacking is further discussed using, and in the description for, FIG. 16D.

Figure 16C:
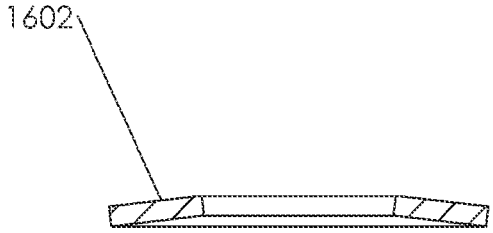
FIG. 16C shows a cross-sectional view of one example of the Belleville Disc Spring.

FIG. 16C shows a cross-sectional view of one example of the Belleville Disc Spring. FIG. 16C shows one example of the formed shape of Locking Spring 1602. In one example, Locking Spring 1602 is composed, shaped, positioned and arranged to deflect downward and have a subsequent reduction in height when subjected to a compressive force.

Figure 16D:
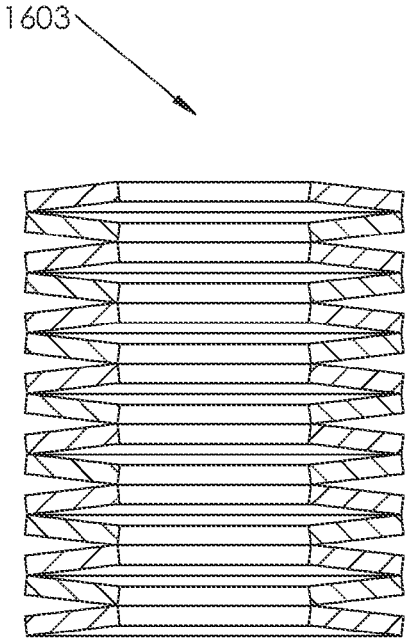
FIG. 16D shows a cross-sectional view of one example of the Locking Spring Stack.

FIG. 16D shows a cross-sectional view of one example of the Locking Spring Stack. Locking Spring Stack 1603 is comprised of two or more Locking Springs 1602, deployed as part of the locking mechanism for Locking Pin Treatment Valve 1400. In one example, the stack arrangement is a series stack, meaning that each individual spring is stacked in an alternating orientation. A series stack is used to retain the working load of a single Belleville Disc Spring, or equivalent, while increasing the working deflection. In one example, a parallel stack is formed by arrangement where individual springs are stacked in the same orientation, retaining the working deflection of a single Belleville Disc Spring, or equivalent, while increasing the working load. In one example, a parallel-series combination stack is deployed, having a combination of individual springs, some stacked in parallel and some in stacked in series, resulting in both a working load and working deflection larger than a single Belleville Disc Spring, or equivalent.

Figures 17A, 17B:
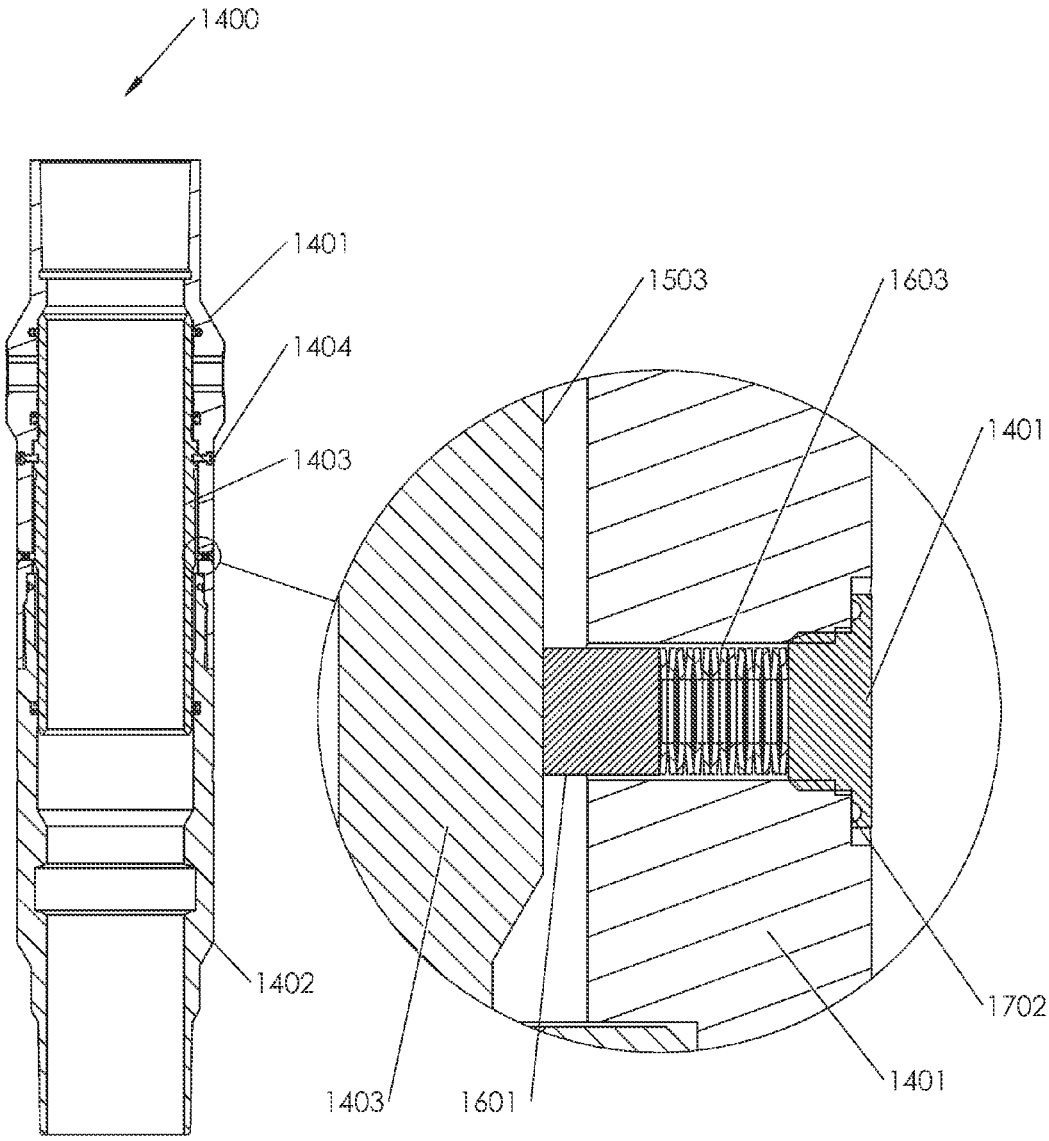
FIG. 17A shows a cross-sectional view of one example of the treatment valve assembly configured to use locking pins, shown in the closed position.
FIG. 17B shows a cross-sectional detail-view of one example of the Locking Mechanism in the closed position.

FIG. 17A shows a cross-sectional view of one example of the treatment valve assembly configured to use locking pins, shown in the closed position. FIG. 17A is a cross-sectional view of the Locking Pin Treatment Valve in the closed position 1400 and is included to provide the location of the Locking Pin Mechanism, as shown in FIG. 17B, while the Locking Pin Treatment Valve is closed.

FIG. 17B shows a cross-sectional detail-view of one example of the Locking Mechanism in the closed position. FIG. 17B is a detail view of the Locking Pin Mechanism. The Locking Pin 1601 and Locking Spring Stack 1603 are radially disposed of in the Locking Pin Ported Top Sub 1401 and retained in place with a Retaining Screw 1701. An Oring Seal 1702 is radially disposed on Retaining Screw 1701 to seal Locking Chamber 1499. In the closed position 1400, the Locking Pin 1601 is in contact with the Locking Pin Running Surface 1503 of Locking Pin Inner Sleeve 1403 and Locking Spring Stack 1603 is compressed. When a downward force is applied to Locking Pin Inner Sleeve 1401, sufficient to break Shear Screws 1404, the Locking Pin Inner Sleeve 1403 will shift downward and Locking Pin(s) 1601 will ride on Locking Pin Running Surface 1503.

Figures 18A, 18B, 18C:
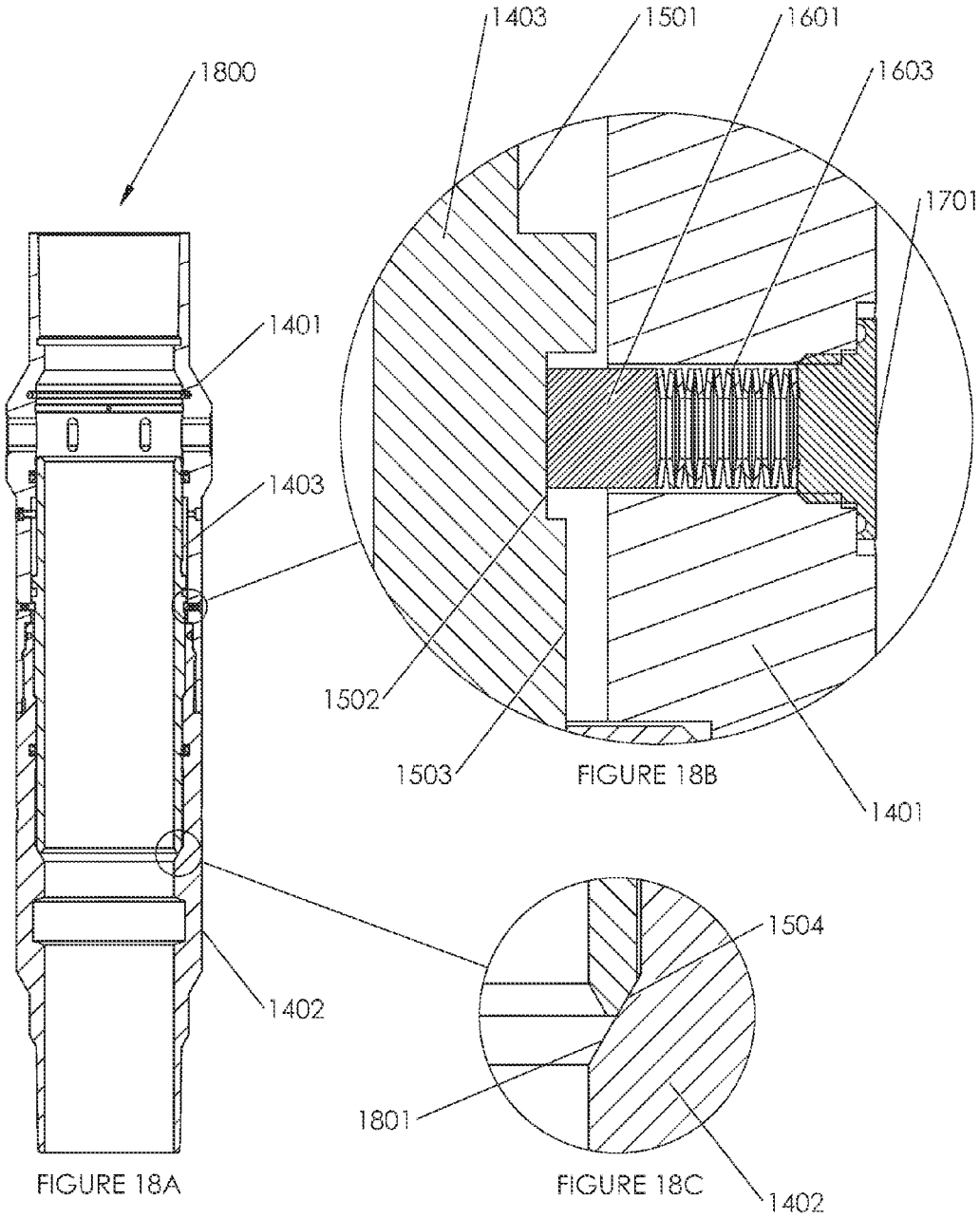
FIG. 18A shows a cross-sectional view of one example of the treatment valve assembly configured to use locking pins, shown in the open and locked position.
FIG. 18B shows a cross-sectional detail-view of one example of the Locking Mechanism in the open and locked position.
FIG. 18C shows a cross-sectional detail-view of one example of a shoulder stop surface, shouldering Locking Pin Inner Sleeve in Locking Pin Bottom Sub.

FIG. 18A shows a cross-sectional view of one example of the treatment valve assembly configured to use locking pins, shown in the open and locked position. FIG. 18A is a cross-sectional view of the Locking Pin Treatment Valve in the open and locked position 1800 and is included to provide the location of the Locking Pin Mechanism, as shown in FIG. 18B, and the shouldering features in FIG. 18C, while the Locking Pin Treatment Valve is closed.

FIG. 18B shows a cross-sectional detail-view of one example of the Locking Mechanism in the open and locked position 1800. Locking Pin 1601 is engaged in Locking Groove 1502 of Locking Pin Inner Sleeve 1403. Locking Spring Stack 1603 is shown in an extended state, which forces Locking Pin 1601 into Locking Groove 1503. In this state Locking Pin 1601 is engaged in both Locking Pin Ported Top Sub 1401 and Locking Groove 1503, which prevents further movement of Locking Pin Inner Sleeve 1403, thus retaining the Locking Pin Treatment Valve in the open and locked position 1800.

FIG. 18C is a detailed view that shows the shouldering of the Locking Pin Inner Sleeve, 1403, in the Locking Pin Bottom Sub, 1402. The engagement occurs at the Locking Pin Inner Sleeve Shouldering Face 1504 and the Locking Pin Bottom Sub Shouldering Face 1801. The interaction of these two faces achieve the open and locked position 1800 of the Locking Pin Treatment Valve 1400.

FIG. 18C shows a cross-sectional detail-view of one example of a shoulder stop surface, shouldering Locking Pin Inner Sleeve 1403 in Locking Pin Bottom Sub 1402. The contact engagement occurs at Locking Pin Inner Sleeve Shouldering Face 1504 and Locking Pin Bottom Sub Shouldering 1801. In one example, the interaction of the two faces control the longitudinal positioning of Locking Pin Inner Sleeve 1403, preventing any downward loading of Locking Pin(s) 1601. In one example, the shouldered faces are placed at 60 degree angles.

Figure 19:
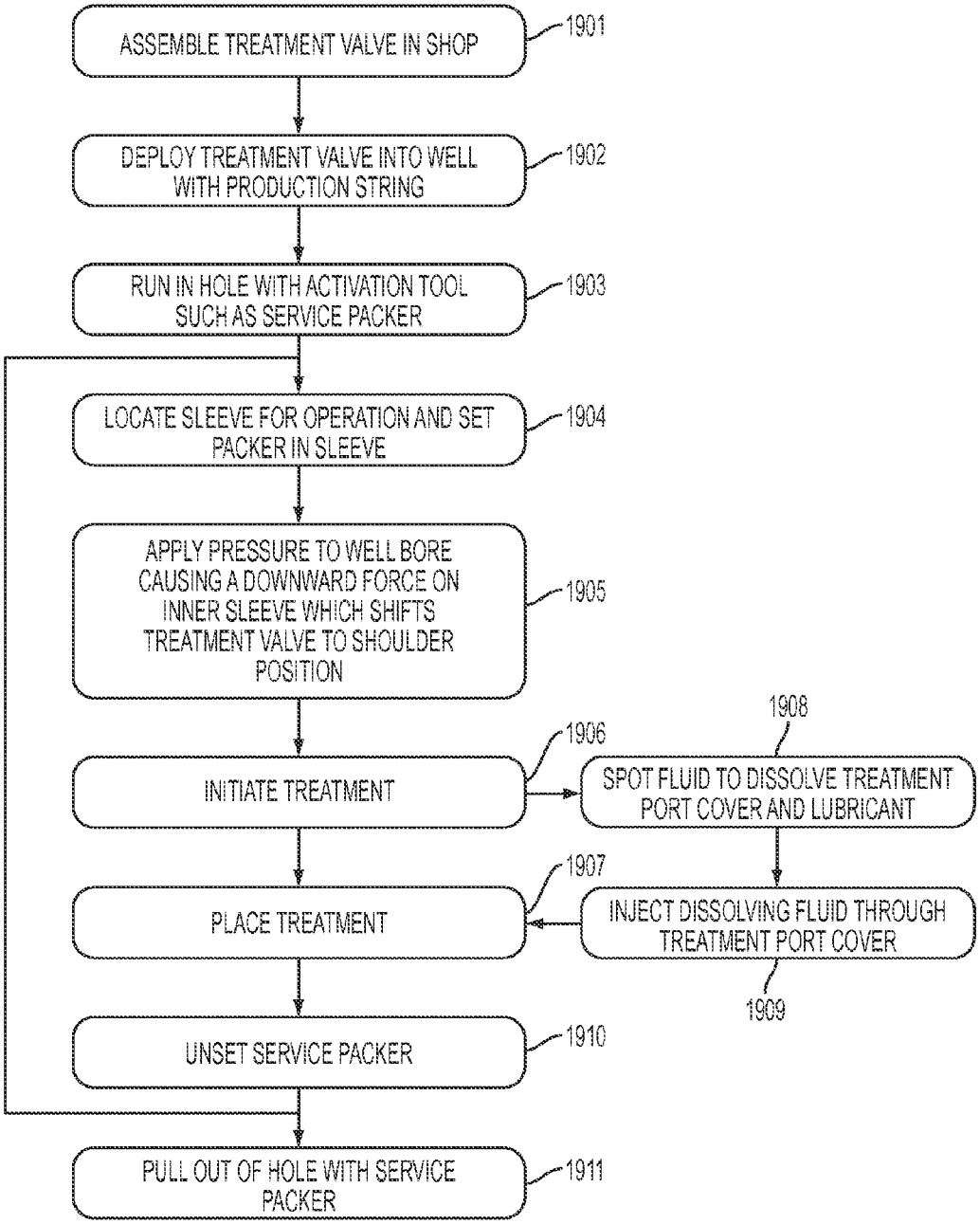
FIG. 19 shows a flowchart describing an example of the method of operation of the Treatment Valve.

FIG. 19 shows a flowchart describing examples of the method of operation of the Treatment Valve. In one example, the treatment valve assembly is assembled, in one example, in a shop (step 1901), and then deployed it in a wellbore, in one example, using a production string (step 1902). In one example, the treatment valve assembly is run in the wellbore with an activation tool (step 1903). In one example, the activation tool is a service packer. In one example, a service packer is deployed and set in the Treatment Valve 100. In one example, the service packer is deployed with Coiled Tubing. In one example, the service packer is deployed with jointed pipe. In one example, Treatment Valve 100 is first located by using Locator Groove 211 or equivalent marker (step 1904). After locating Treatment Valve 100, and setting the service packer, Treatment Valve 100 is shifted open (step 1905) and the treatment placed (steps 1906, 1907). In one example, if the treatment cannot be initiated, a dissolving fluid is placed across Treatment Valve 100 and forced through Treatment Port Cover 402 (steps 1908, 1909), and then the treatment is placed (step 1907). After the treatment has been placed the service packer is unset (step 1910). If there are more Treatment Valves 100 to be utilized, the process is started again at locating the Treatment Valve 100 (step 1904). If there are no more Treatment Valves 100 to be utilized, the service packer is pulled out of hole (step 1911).

While this invention has been described with respect to a limited number of embodiments, those skilled in the art, having benefit of this disclosure, will appreciate that other embodiments can be devised which do not depart from the scope of the invention disclose.

While the invention has been illustrated and described in detail in the drawings and foregoing description, such illustration and description are to be considered illustrative or exemplary and not restrictive and it is not intended to limit the invention to the disclosed embodiments. The mere fact that certain measures are recited in mutually different dependent claims does not indicate that a combination of these measures cannot be used advantageously. Any reference signs in the claims should not be construed as limiting the scope of the invention.

The invention claimed is:

1. A system for selectively treating zones in a cased wellbore, the system comprising:

a downhole tool, having a body, an inner bore therethrough, an inner surface of the body formed by the inner bore, and an outer surface;

at least one treatment port disposed on the outer surface of the body;

means for selectively isolating the inner bore from the outer surface, the means for selectively isolating the inner bore comprising a sliding sleeve disposed within the inner bore of the body;

means for isolating, the means comprising an annular chamber between inner surface of the body and an outer surface of the sliding inner sleeve, the chamber in isolation from the inner bore and the outer surface;

means for maintaining the inner sliding sleeve in an open position, the means for maintaining disposed within the annular chamber; and means for maintaining the inner sliding sleeve in a closed position.

2. The system of claim 1 wherein the means for isolating the annular chamber comprises:

a first seal disposed in a fixed position on the inner surface, the outer surface of the inner sliding sleeve being slidably disposed on the first seal, the first seal disposed in a position on the inner surface of the body that is longitudinally proximate to a first end of the inner sliding sleeve when the inner sleeve is positioned in the open position; and a second seal disposed in a fixed position on the inner surface of the body, the outer surface of the inner sliding sleeve being slidably disposed on the second seal, the second seal disposed in a fixed position on the inner surface of the body that is longitudinally proximate to a second end of the inner sliding sleeve when the inner sleeve is positioned in the closed position; and wherein the first seal and the second seal are disposed in longitudinal positions such that the annular chamber maintains isolation when the inner sleeve is positioned in either the open position or in the closed position.

3. The system of claim 2 wherein the first seal comprises an energized seal ring.

4. The system of claim 2 wherein the second seal comprises an energized seal ring.

5. The system of claim 2 wherein the first seal comprises a lip seal disposed in an open-faced outward position with respect to the end of the inner sleeve.

6. The system of claim 5 wherein the second seal comprises an energized seal ring.

7. The system of claim 2 wherein the second seal comprises a lip seal disposed in an open-faced outward position with respect to the end of the inner sleeve.

8. The system of claim 7 wherein the first seal comprises an energized seal ring.

9. The system of claim 2 comprising a third seal disposed in a fixed position on the inner surface of the body, the outer surface of the inner sliding sleeve being slidably disposed on the third seal, wherein the third seal is disposed in a fixed position on the body that is longitudinally proximate to the one first end of the inner sliding sleeve when the inner sleeve is positioned in the closed position.

10. The system of claim 9 wherein the first seal comprises an energized seal ring.

11. The system of claim 9 wherein the second seal comprises an energized seal ring.

12. The system of claim 9 wherein the third seal is an energized seal ring.

13. The system of claim 12 wherein the first seal comprises a lip seal disposed in an open-faced outward position with respect to the end of the inner sleeve and the second seal comprises a lip seal disposed in an open-faced outward position with respect to the end of the inner sleeve.

14. The system of claim 12 wherein the first seal comprises an energized seal ring.

15. The system of claim 12 wherein the second seal comprises an energized seal ring.

16. The system of claim 12 wherein the first seal comprises an energized seal ring and the second seal comprises an energized seal ring.

17. The system of claim 9 wherein the treatment ports are positioned between the first and third seals.

18. The system of claim 17 wherein the third seal comprises an energized seal ring.

19. The system of claim 2 comprising means for lubricating the sliding engagement of the outer surface of the inner sleeve with the inner surface of the body the means for lubricating comprises lubricating ports disposed on the outer surface of the tool, forming an orifice bore to the inner bore, disposed longitudinally between the first and third seals and isolated from communication with the annular chamber.

20. The system of claim 19 wherein the lubricating ports comprise plugs.

21. The system of claim 2 wherein the first seal and the second seal are disposed in longitudinal positions such that the annular chamber maintains isolation when the inner sleeve is positioned in any position.

22. The system of claim 2 wherein the annular chamber is a constant volume chamber when the inner sliding sleeve is in any position.

23. The system of claim 1 comprising means for excluding debris existing outside the tool from entering the treatment port.

24. The system of claim 23 wherein the means for excluding comprises a cover disposed on the outer surface of the body over the treatment port.

25. The system of claim 24 wherein a recess is disposed about the at least one treatment port on the outer surface of the body for receiving the cover within the recess.

26. The system of claim 25 wherein the cover is adhered to the recess by an adhesive.

27. The system of claim 25 wherein the cover is adhered to the recess by a solder.

28. The system of claim 24 wherein the cover comprises a material that is dissolvable by a fluid.

29. The system of claim 24 wherein the cover comprises a material that is dissolvable by a fluid that is compatible with a formation.

30. The system of claim 24 wherein the cover comprises means for rupturing upon applying pressure from the inner bore.

31. The system of claim 30 wherein the cover comprises a material that is dissolvable by a fluid.

32. The system of claim 30 wherein the cover comprises a material that is dissolvable by a fluid that is compatible with a formation.

33. The system of claim 24 wherein the treatment port cover comprises means for permeating a dissolving solution to both sides of the cover.

34. The system of claim 33 wherein the means for permeating comprises one or more orifices in the treatment cover.

35. The system of claim 24 wherein the treatment port cover comprises one or more orifices.

36. The system of claim 23 wherein the means for excluding comprises a cover disposed in the fluid communication path of the treatment port.

37. The system of claim 36 wherein the cover comprises means for rupturing upon applying pressure from the inner bore.

38. The system of claim 37 wherein the treatment port cover is comprised of a dissolvable material.

39. The system of claim 36 wherein the treatment port cover comprises means for permeating a dissolving solution to both sides of the cover.

40. The system of claim 39 wherein the means for permeating comprises one or more orifices in the treatment cover.

41. The system of claim 36 wherein the treatment port cover comprises one or more orifices.

42. The system of claim 1 comprising means for lubricating the sliding engagement of the outer surface of the inner sleeve with the inner surface of the body.

43. The system of claim 42 wherein the means for lubricating comprises lubricating ports disposed on the outer surface of the tool, forming an orifice bore to the inner bore.

44. The system of claim 43 wherein the lubricating ports comprise plugs.

45. The system of claim 1 wherein the annular chamber is a constant volume chamber when the inner sliding sleeve is in any position.

46. The system of claim 1 comprising:

means for holding the inner sliding sleeve in an open position, the means comprising a collet disposed around the outer surface of the inner sleeve;

at least one finger on the collet shaped to engage the inner surface for holding the sleeve in an open position; and wherein the inner surface is shaped at a predetermined location for engagably receiving the collet.

47. The system of claim 46 wherein said collet comprises at least two fingers on the collet shaped to engage the inner surface for holding the sleeve in an open position.

48. The system of claim 46 wherein the means for isolating the annular chamber comprises:

a first seal disposed in a fixed position on the inner surface of the body, the outer surface of the inner sliding sleeve being slidably disposed on the first seal, the first seal disposed in a position on the inner surface that is longitudinally proximate to a first end of the inner sliding sleeve when the inner sleeve is positioned in the open position; and a second seal disposed in a fixed position on the inner surface of the body, the outer surface of the inner sliding sleeve being slidably disposed on the second seal, the second seal disposed in a fixed position on the inner surface that is longitudinally proximate to a second end of the inner sliding sleeve when the inner sleeve is positioned in the closed position; and wherein the first seal and the second seal are disposed in longitudinal positions such that the annular chamber maintains isolation when the inner sleeve is positioned in either the open position or in the closed position.

49. The system of claim 48 wherein the first seal comprises an energized seal ring.

50. The system of claim 49 wherein the first seal and the second seal are disposed in longitudinal positions such that the annular chamber maintains isolation when the inner sleeve is positioned in any position.

51. The system of claim 49 wherein the annular chamber is a constant volume chamber when the inner sliding sleeve is in any position.

52. The system of claim 48 wherein the second seal comprises an energized seal ring.

53. The system of claim 48 wherein the first seal comprises a lip seal disposed in an open-faced outward position with respect to the end of the inner sleeve.

54. The system of claim 53 wherein the second seal comprises an energized seal ring.

55. The system of claim 48 wherein the second seal comprises a lip seal disposed in an open-faced outward position with respect to the end of the inner sleeve.

56. The system of claim 55 wherein the first seal comprises an energized seal ring.

57. The system of claim 48 comprising a third seal disposed in a fixed position on the inner surface of the body, the outer surface of the inner sliding sleeve being slidably disposed on the third seal, wherein the third seal is disposed in a fixed position on the body that is longitudinally proximate to the one first end of the inner sliding sleeve when the inner sleeve is positioned in the closed position.

58. The system of claim 57 wherein the first seal comprises an energized seal ring.

59. The system of claim 57 wherein the second seal comprises an energized seal ring.

60. The system of claim 57 wherein the third seal is an energized seal ring.

61. The system of claim 60 wherein the first seal comprises a lip seal disposed in an open-faced outward position with respect to the end of the inner sleeve and the second seal comprises a lip seal disposed in an open-faced outward position with respect to the end of the inner sleeve.

62. The system of claim 60 wherein the first seal comprises an energized seal ring.

63. The system of claim 60 wherein the second seal comprises an energized seal ring.

64. The system of claim 60 wherein the first seal comprises an energized seal ring and the second seal comprises an energized seal ring.

65. The system of claim 57 wherein the treatment ports are positioned between the first and third seals.

66. The system of claim 65 wherein the third seal comprises an energized seal ring.

67. The system of claim 46 comprising means for excluding debris existing outside the tool from entering the treatment port.

68. The system of claim 67 wherein the means for excluding comprises a cover disposed on the outer surface of the body over the treatment port.

69. The system of claim 68 wherein a recess is disposed about the at least one treatment port on the outer surface of the body for receiving the cover within the recess.

70. The system of claim 69 wherein the cover is adhered to the recess by an adhesive.

71. The system of claim 69 wherein the cover is adhered to the recess by a solder.

72. The system of claim 68 wherein the cover comprises a material that is dissolvable by a fluid.

73. The system of claim 68 wherein the cover comprises a material that is dissolvable by a fluid that is compatible with a formation.

74. The system of claim 68 wherein the cover comprises means for rupturing upon applying pressure from the inner bore.

75. The system of claim 74 wherein the cover comprises a material that is dissolvable by a fluid.

76. The system of claim 74 wherein the cover comprises a material that is dissolvable by a fluid that is compatible with a formation.

77. The system of claim 68 wherein the treatment port cover comprises means for permeating a dissolving solution to both sides of the cover.

78. The system of claim 77 wherein the means for permeating comprises one or more orifices in the treatment cover.

79. The system of claim 68 wherein the treatment port cover comprises one or more orifices.

80. The system of claim 67 wherein the means for excluding comprises a cover disposed in the fluid communication path of the treatment port.

81. The system of claim 80 wherein the cover comprises means for rupturing upon applying pressure from the inner bore.

82. The system of claim 81 wherein the treatment port cover is comprised of a dissolvable material.

83. The system of claim 80 wherein the treatment port cover comprises means for permeating a dissolving solution to both sides of the cover.

84. The system of claim 83 wherein the means for permeating comprises one or more orifices in the treatment cover.

85. The system of claim 80 wherein the treatment port cover comprises one or more orifices.

86. The system of claim 46 comprising means for lubricating the sliding engagement of the outer surface of the inner sleeve with the inner surface of the body.

87. The system of claim 86 wherein the means for lubricating comprises lubricating ports disposed on the outer surface of the tool, forming an orifice bore to the inner bore.

88. The system of claim 87 wherein the lubricating ports comprise plugs.

89. The system of claim 46 comprising means for lubricating the sliding engagement of the outer surface of the inner sleeve with the inner surface of the body, the means for lubricating comprising lubricating ports disposed on the outer surface of the tool, forming an orifice bore to the inner bore, disposed longitudinally between the first and third seals and isolated from communication with the annular chamber.

90. The system of claim 89 wherein the lubricating ports comprise plugs.

91. The system of claim 46 wherein the annular chamber is a constant volume chamber when the inner sliding sleeve is in any position.

92. A method for treatment of a well comprising:

locating a treatment tool in a well;

setting an activation tool in the well;

placing a treatment;

unsetting the activation tool; and wherein the treatment tool comprises:

a body having an inner bore therethrough, an inner surface of the body formed by the inner bore, and an outer surface;

at least one treatment port disposed on the outer surface of the tool, providing fluid communication between the inner bore the outer surface;

means for selectively isolating the inner bore from the outer surface, the means for selectively isolating the inner bore comprising a sliding sleeve disposed within the inner bore, the inner sliding sleeve positioned in a closed position or open position with respect to the at least one treatment port;

means for maintaining the inner sliding sleeve in an open position; and means for maintaining the inner sliding sleeve in a closed position; and wherein the treatment tool comprises means for isolating, the means comprising an annular chamber between inner surface of the body and an outer surface of the sliding inner sleeve, the chamber in isolation from the inner bore and the outer surface of the body.

93. The method of claim 92 wherein a plurality of treatment tools are first deployed in the well and the steps of locating, setting, placing a treatment, and unsetting are repeated for at least two of the plurality of treatment tools.

94. The method of claim 92 wherein the activation tool is a service packer.

95. The method of claim 92 wherein the treatment tool is first located using a marker disposed in the treatment tool.

96. The method of claim 95 wherein the marker is a groove disposed in the treatment tool.

97. The method of 92 wherein the treatment tool is deployed in the well using a production string.

98. The method of 92 wherein the activation tool is deployed in the well using coiled tubing.

99. The method of 92 wherein the activation tool is deployed in the well using jointed pipe.

100. The method of claim 92 wherein the annular chamber is a constant volume chamber when the inner sliding sleeve is in any position.

101. The method of claim 100 wherein a plurality of treatment tools are first deployed in the well and the steps of locating, setting, placing a treatment, and unsetting are repeated for at least two of the plurality of treatment tools.

102. The method of claim 100 wherein the activation tool is a service packer.

103. The method of claim 100 wherein the treatment tool is first located using a marker disposed in the treatment tool.

104. The method of claim 103 wherein the marker is a groove disposed in the treatment tool.

105. The method of 100 wherein the treatment tool is deployed in the well using a production string.

106. The method of 100 wherein the activation tool is deployed in the well using coiled tubing.

107. The method of 100 wherein the activation tool is deployed in the well using jointed pipe.

108. A method for treatment of a well comprising:

locating a treatment tool in a well;

setting an activation tool in the well;

placing a treatment;

unsetting the activation tool; and wherein the treatment tool comprises:

a body having an inner bore therethrough, an inner surface of the body formed by the inner bore, and an outer surface;

at least one treatment port disposed on the outer surface of the tool, providing fluid communication between the inner bore the outer surface;

means for selectively isolating the inner bore from the outer surface, the means for selectively isolating the inner bore comprising a sliding sleeve disposed within the inner bore, the inner sliding sleeve positioned in a closed position or open position with respect to the at least one treatment port;

means for maintaining the inner sliding sleeve in an open position;

means for maintaining the inner sliding sleeve in a closed position;

means for isolating, the means comprising an annular chamber between inner surface of the body and an outer surface of the sliding inner sleeve, the chamber in isolation from the inner bore and the outer surface of the body; and means for repeatably placing the inner sliding sleeve in an open or closed position, the means comprising a collet disposed around the outer surface of the sliding sleeve and a receiving groove disposed on the inner surface of the body.

109. The system of claim 108 wherein the annular chamber is a constant volume chamber when the inner sliding sleeve is in any position.

110. A method for treatment of a well comprising:

locating a treatment tool in a well;

setting an activation tool in the well;

placing a treatment;

unsetting the activation tool; and wherein the treatment tool comprises:

a body having an inner bore therethrough, an inner surface of the body formed by the inner bore, and an outer surface;

at least one treatment port disposed on the outer surface of the tool, providing fluid communication between the inner bore the outer surface;

means for selectively isolating the inner bore from the outer surface, the means for selectively isolating the inner bore comprising a sliding sleeve disposed within the inner bore, the inner sliding sleeve positioned in a closed position or open position with respect to the at least one treatment port;

means for isolating, the means comprising an annular chamber between inner surface of the body and an outer surface of the sliding inner sleeve, the chamber in isolation from the inner bore and the outer surface;

means for maintaining the inner sliding sleeve in an open position, the means for maintaining disposed within the annular chamber; and means for maintaining the inner sliding sleeve in a closed position.

111. The method of claim 110 wherein a plurality of treatment tools are first deployed in the well and the steps of locating, setting, placing a treatment, and unsetting are repeated for at least two of the plurality of treatment tools.

112. The method of claim 110 wherein the activation tool is a service packer.

113. The method of claim 110 wherein the treatment tool is first located using a marker disposed in the treatment tool.

114. The method of claim 113 wherein the marker is a groove disposed in the treatment tool.

115. The method of 110 wherein the treatment tool is deployed in the well using a production string.

116. The method of 110 wherein the activation tool is deployed in the well using coiled tubing.

117. The method of 110 wherein the activation tool is deployed in the well using jointed pipe.

118. The method of claim 110 wherein the annular chamber is a constant volume chamber when the inner sliding sleeve is in any position.

119. A method for treatment of a well comprising:

locating a treatment tool in a well;

setting an activation tool in the well;

placing a treatment;

unsetting the activation tool; and wherein the treatment tool comprises:

a body having an inner bore therethrough, an inner surface of the body formed by the inner bore, and an outer surface;

at least one treatment port disposed on the outer surface of the tool, providing fluid communication between the inner bore the outer surface;

means for selectively isolating the inner bore from the outer surface, the means for selectively isolating the inner bore comprising a sliding sleeve disposed within the inner bore, the inner sliding sleeve positioned in a closed position or open position with respect to the at least one treatment port;

means for isolating, the means comprising an annular chamber between inner surface of the body and an outer surface of the sliding inner sleeve, the chamber in isolation from the inner bore and the outer surface;

means for maintaining the inner sliding sleeve in an open position, the means for maintaining disposed within the annular chamber;

means for maintaining the inner sliding sleeve in a closed position; and means for repeatably placing the inner sliding sleeve in an open or closed position, the means comprising a collet disposed around the outer surface of the sliding sleeve and a receiving groove disposed on the inner surface of the body.

120. The system of claim 119 wherein the annular chamber is a constant volume chamber when the inner sliding sleeve is in any position.

* * * * *